US010839746B2

(12) United States Patent
Ohnishi

(10) Patent No.: US 10,839,746 B2
(45) Date of Patent: Nov. 17, 2020

(54) DISPLAY DEVICE AND IMAGE DATA CORRECTION METHOD

(71) Applicant: SHENZHEN TOREY MICROELECTRONIC TECHNOLOGY CO. LTD., Shenzhen (CN)

(72) Inventor: Mitsuhisa Ohnishi, Sakai (JP)

(73) Assignee: SHENZHEN TOREY MICROELECTRONIC TECHNOLOGY CO. LTD., Shenzhen (CN)

( * ) Notice: Subject to any disclaimer, the term of this patent is extended or adjusted under 35 U.S.C. 154(b) by 0 days.

(21) Appl. No.: 16/619,918

(22) PCT Filed: Mar. 23, 2018

(86) PCT No.: PCT/JP2018/011776
§ 371 (c)(1),
(2) Date: Dec. 5, 2019

(87) PCT Pub. No.: WO2018/225338
PCT Pub. Date: Dec. 13, 2018

(65) Prior Publication Data

US 2020/0211454 A1 Jul. 2, 2020

(30) Foreign Application Priority Data

Jun. 7, 2017 (JP) ..... 2017-112445

(51) Int. Cl.
*G09G 3/3225* (2016.01)

(52) U.S. Cl.
CPC ... *G09G 3/3225* (2013.01); *G09G 2320/0626* (2013.01)

(58) Field of Classification Search
CPC ..... G09G 3/3225; G09G 2320/0626
See application file for complete search history.

(56) References Cited

U.S. PATENT DOCUMENTS

| | | | |
|---|---|---|---|
| 2003/0063053 | A1 | 4/2003 | Yamazaki et al. |
| 2004/0150594 | A1 | 8/2004 | Koyama et al. |
| 2010/0265228 | A1 | 10/2010 | Kimura et al. |
| 2011/0069051 | A1 | 3/2011 | Nakamura et al. |
| 2016/0165700 | A1 | 6/2016 | Takahashi et al. |

(Continued)

FOREIGN PATENT DOCUMENTS

| | | | |
|---|---|---|---|
| JP | 2003-177713 | A | 6/2003 |
| JP | 2004-070349 | A | 3/2004 |

(Continued)

*Primary Examiner* — Sejoon Ahn
(74) *Attorney, Agent, or Firm* — ScienBiziP, P.C.

(57) ABSTRACT

A display device includes: a deterioration amount increment calculation unit that calculates an increment of a deterioration amount of an organic light-emitting element included in each of pixels, based on gradation data included in image data; a deterioration amount accumulation unit that accumulates, every fixed time, the increment of the deterioration amount calculated by the deterioration amount increment calculation unit; and a correction unit that corrects luminance of the pixel based on a total amount of increments of the deterioration amount accumulated by the deterioration amount accumulation unit.

3 Claims, 11 Drawing Sheets

(56) References Cited

U.S. PATENT DOCUMENTS

| | | | | |
|---|---|---|---|---|
| 2017/0372662 | A1* | 12/2017 | Zhang | G09G 3/3275 |
| 2017/0372665 | A1* | 12/2017 | Han | G06F 1/1626 |
| 2017/0372666 | A1* | 12/2017 | Umeyama | G09G 3/36 |

FOREIGN PATENT DOCUMENTS

| | | | |
|---|---|---|---|
| JP | 2007-178837 | A | 7/2007 |
| JP | 2010-243895 | A | 10/2010 |
| JP | 2010-250171 | A | 11/2010 |
| JP | 2011-065047 | A | 3/2011 |
| JP | 2014-013335 | A | 1/2014 |
| JP | 2016-109914 | A | 6/2016 |

* cited by examiner

205: REGION
W1: WHITE PIXEL
B1: BLACK PIXEL

205: REGION
W1: WHITE PIXEL
B1: BLACK PIXEL

205: REGION
W1: WHITE PIXEL
B1: BLACK PIXEL

205: REGION
W1: WHITE PIXEL
B1: BLACK PIXEL

DISPLAY DEVICE AND IMAGE DATA CORRECTION METHOD

TECHNICAL FIELD

The present invention relates to a display device and an image data correction method.

BACKGROUND ART

As a device that has particularly attracted attention in recent years, there is an OELD (Organic Electro Luminescence Display). The OELD is a display device that emits light in accordance with an electric signal and is constituted by using an organic compound as a light-emitting substance. The OELD naturally has excellent display characteristics such as a wide viewing angle, a high contrast, and a high-speed response. Moreover, the OELD may achieve display devices from a small display device to a large display device, which are thin, and have light weight and high image quality, and is thus attracting attention as a display device as a substitute for a CRT (Cathode Ray Tube) or an LCD (Liquid Crystal Display).

Meanwhile, an organic EL element used for the OLED has a problem of deterioration resulting from a change over time and a temperature change.

In order to correct such deterioration, PTL 1 discloses a display device having two compensation functions of an aging compensation function and a temperature compensation function in order to correct deterioration resulting from a temperature change.

PTL 2 discloses a self-light-emitting display device that corrects at least one of light emission luminance of at least one pixel included in a first region where deterioration is to be monitored and light emission luminance of at least one pixel included in a second region so that a difference of the light emission luminance is reduced.

PTL 3 discloses a display device that controls an amount of current, which is supplied to a light-emitting element, on the basis of a detection result of an optical sensor and a voltage maintained in a capacitor.

PTL 4 discloses a display device that estimates a luminance deterioration ratio of each display pixel by using a luminance deterioration function derived from a light reception signal of a reference pixel and a history of a video signal of each display pixel.

CITATION LIST

Patent Literature

PTL 1: Japanese Unexamined Patent Application Publication No. 2004-070349 (published on Mar. 4, 2004)

PTL 2: Japanese Unexamined Patent Application Publication No. 2010-243895 (published on Oct. 28, 2010)

PTL 3: Japanese Unexamined Patent Application Publication No. 2016-109914 (published on Jun. 20, 2016)

PTL 4: Japanese Unexamined Patent Application Publication No. 2011-065047 (published on Mar. 31, 2011)

SUMMARY OF INVENTION

Technical Problem

In the display device disclosed in PTL 2, image data is difficult to correct unless a displayed image is fixed and a deterioration part is known in advance.

Thus, in a case where a displayed image is different each time, image data needs to be corrected by acquiring information about deterioration of each of light-emitting elements as in the display device disclosed in PTL 3 or PTL 4. In a case where the number of pixels increases due to an increase in size of a screen and/or an increase in definition, however, there is a problem that an amount of information about deterioration becomes enormous and the information about deterioration is difficult to store in a memory or the like.

An aspect of the invention aims to achieve a display device capable of correcting image data for a long time period even in a case where the number of pixels is large.

Solution to Problem

In order to solve the aforementioned problem, a display device according to an aspect of the invention is a display device including a display unit in which a plurality of pixels each including an organic light-emitting element are provided, and includes: a calculation unit that calculates an increment of a deterioration amount of the organic light-emitting element included in each of the pixels, based on gradation data included in image data displayed in the display unit; an accumulation unit that accumulates, every fixed time, the increment of the deterioration amount calculated by the calculation unit; and a correction unit that corrects luminance of the pixel based on a total amount of increments of the deterioration amount accumulated by the accumulation unit.

An image data correction method according to an aspect of the invention is an image data correction method in a display device including a display unit in which a plurality of pixels each including an organic light-emitting element are provided, and includes: a calculation step of calculating an increment of a deterioration amount of the organic light-emitting element included in each of the pixels, based on gradation data included in image data displayed in the display unit; an accumulation step of accumulating, every fixed time, the increment of the deterioration amount calculated at the calculation step; and a correction step of correcting luminance of the pixel based on the deterioration amount accumulated at the accumulation step.

Moreover, a display device according to an aspect of the invention is a display device including a display unit in which a plurality of pixels each including an organic light-emitting element are provided, and includes: a region division unit that divides a display surface of the display unit into a plurality of regions; a total deterioration amount calculation unit that calculates, for each of the regions, a total of increments of deterioration amounts of organic light-emitting elements included in respective pixels in the region, based on gradation data included in image data displayed in the display unit; an average deterioration amount calculation unit that calculates an average of the increments of the deterioration amounts of the organic light-emitting elements based on the total; an average accumulation unit that accumulates the average; and a correction unit that corrects luminance of the pixels based on the average accumulated by the average accumulation unit.

Further, an image data correction method according to an aspect of the invention is an image data correction method in a display device including a display unit in which a plurality of pixels each including an organic light-emitting element are provided, and includes: a region division step of dividing a display surface of the display unit into a plurality of regions; a total deterioration amount calculation step of calculating, for each of the regions, a total of increments of deterioration amounts of organic light-emitting elements included in respective pixels in the region, based on gradation data included in image data displayed in the display unit; an average deterioration amount calculation step of calculating an average of the increments of the deterioration amounts of the organic light-emitting elements based on the total; an average accumulation step of accumulating the average; and a correction step of correcting luminance of the pixels based on the average accumulated at the average accumulation step.

Advantageous Effects of Invention

According to an aspect of the invention, an effect of enabling to correct image data for a long time period even in a case where the number of pixels is large is exerted.

DESCRIPTION OF EMBODIMENTS

Embodiment 1

Figure 1:
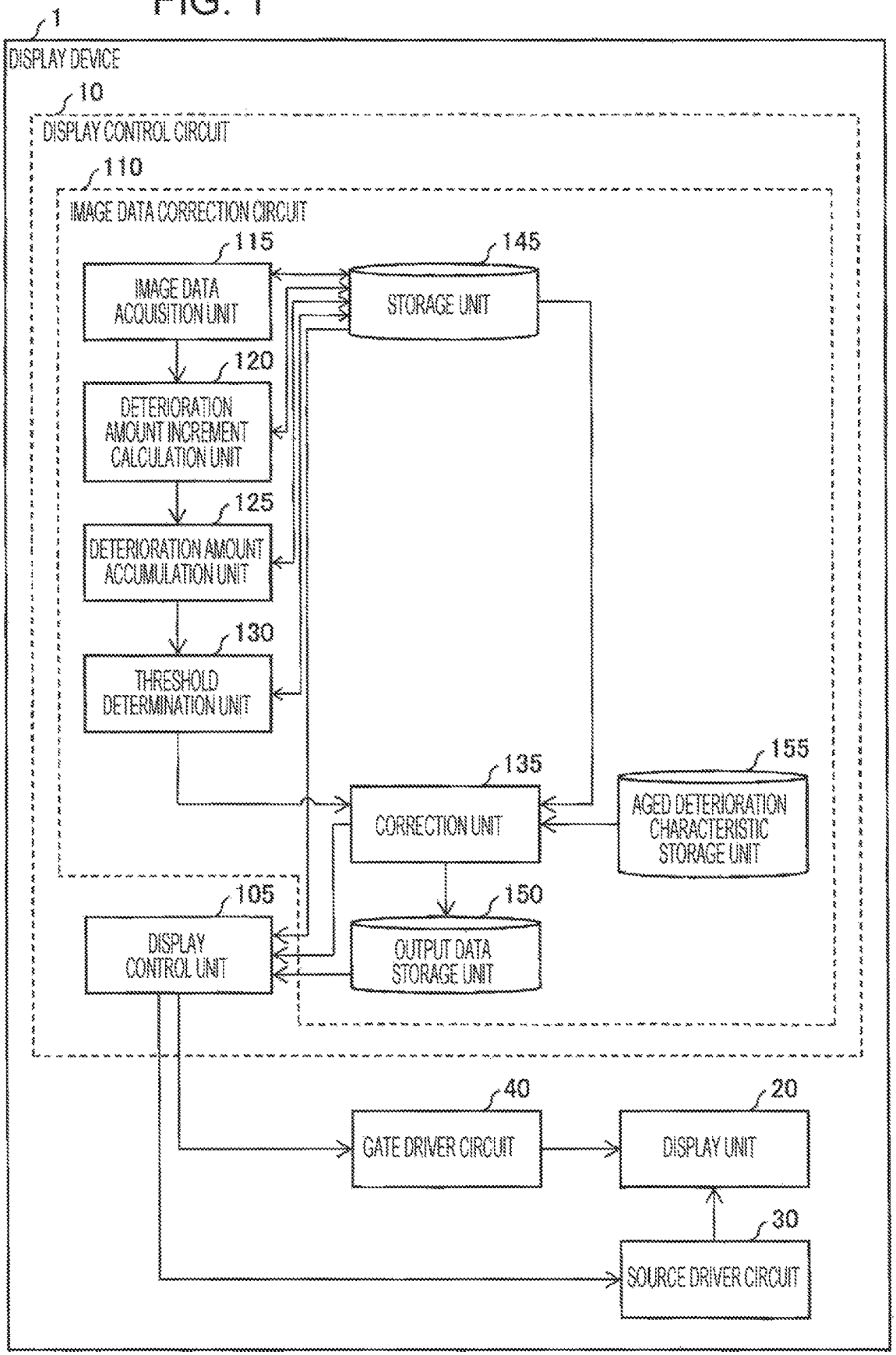
FIG. 1 is a block diagram illustrating a configuration of a display device according to Embodiment 1 of the invention.
Figure 2:
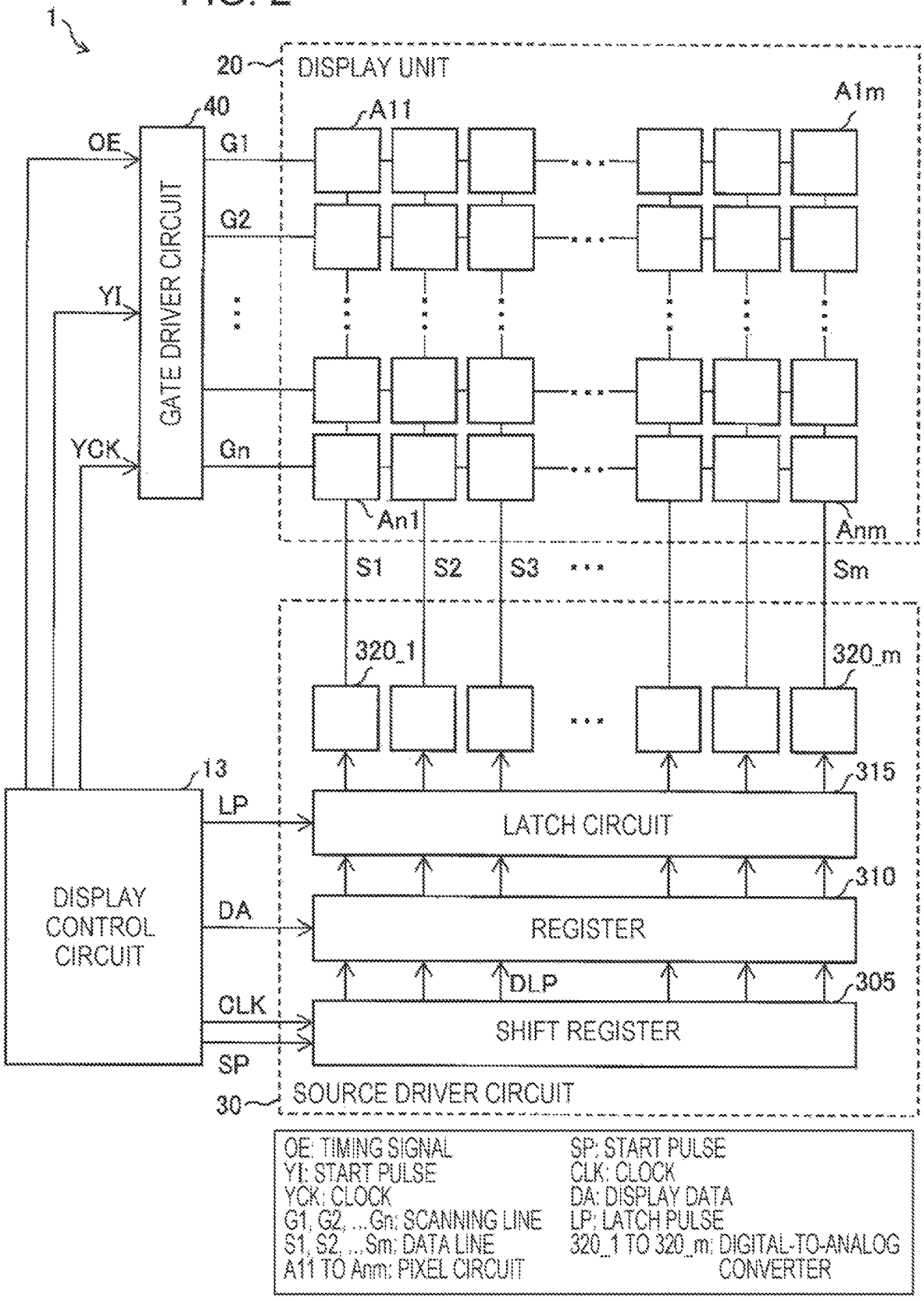
FIG. 2 is another block diagram illustrating the configuration of the display device illustrated in FIG. 1.
Figure 3:
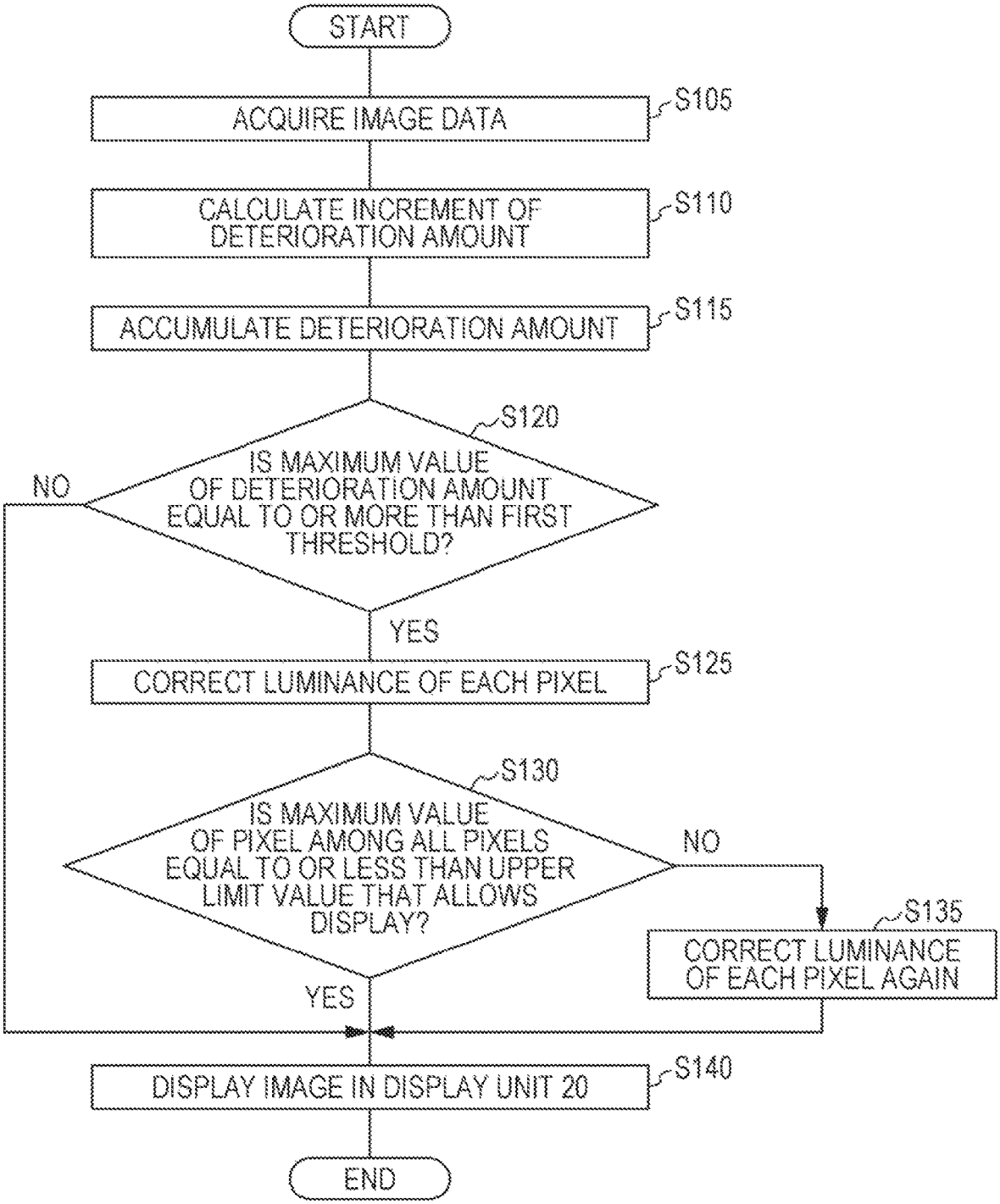
FIG. 3 is a flowchart illustrating operations of the display device illustrated in FIG. 1.

An embodiment of the invention will be described as follows with reference to FIGS. 1 to 3. FIG. 1 is a block diagram illustrating a configuration of a display device 1 according to Embodiment 1 of the invention. FIG. 2 is another block diagram illustrating the configuration of the display device 1. FIG. 3 is a flowchart illustrating operations of the display device 1.

(Configuration of Display Device 1)

As illustrated in FIG. 1, the display device 1 includes a display control circuit 10, a display unit 20, a source driver circuit 30, and a gate driver circuit 40. The display device 1 is a display device using organic electro luminescence.

As illustrated in FIG. 2, the display unit 20 includes a plurality of pixel circuits Aij (i is an integer of 1 or more and n or less and j is an integer of 1 or more and m or less). That is, in the display unit 20, the pixel circuits Aij are provided in a matrix pattern of n rows×m columns. Further, in the display unit 20, a plurality of scanning lines Gi that are arranged in parallel to each other and a plurality of data lines Sj that are arranged to be orthogonal to the plurality of scanning lines Gi and to be parallel to each other are provided. The pixel circuits Aij are arranged correspondingly to respective intersection points of the scanning lines Gi and the data lines Sj. Note that, pixels corresponding to the pixel circuits Aij may be subjected to sub-pixel rendering processing.

Further, in the display unit 20, a plurality of control wires are arranged in parallel to the scanning lines Gi. The control wires are wires provided for driving the pixel circuits Aij. The scanning lines Gi and the control wires are connected to the gate driver circuit 40 and driven by the gate driver circuit 40. The data lines Sj are connected to the source driver circuit 30 and driven by the source driver circuit 30.

A display control unit 105 of the display unit 20 supplies a timing signal OE, a start pulse YI, and a clock YCK to the gate driver circuit 40. The display control unit 105 of the display unit 20 also supplies a start pulse SP, a clock CLK, display data DA, and a latch pulse LP to the source driver circuit 30.

The source driver circuit 30 includes an m-bit shift register 305, an m-bit register 310, an m-bit latch circuit 315, and m digital-to-analog converters 320_1 to **320_*m*. The source driver circuit 30 is a driving circuit for the pixel circuits Aij. The source driver circuit 30 supplies, to the data lines Sj, a display signal that gives a potential (hereinafter, referred to as a data potential) according to the display data DA. Note that, it is assumed here that the source driver circuit 30 performs line sequential scanning where data potentials for one row in the plurality of pixel circuits Aij are simultaneously supplied to pixel circuits Aij connected to one scanning line Gi. Note that, the source driver circuit 30** may perform dot sequential scanning where a data potential is supplied in turn to each of the pixel circuits Aij, instead of the line sequential scanning. A configuration of a source driver circuit that performs dot sequential scanning is known and thus description thereof will be omitted here.

The shift register 305 has m registers (not illustrated) connected in cascade. In the shift register 305, the start pulse SP supplied from the display control unit 105 to a forefront register is sequentially transferred to each stage of registers in synchronization with the clock CLK supplied from the display control unit 105. A timing pulse DLP is supplied from each stage of registers to the register 310, in accordance with a timing when the start pulse SP is supplied to each stage of registers. The display control unit 105 supplies the display data DA to the register 310 in accordance with a timing when the timing pulse DLP is supplied to the register 310.

The register 310 stores the display data DA supplied from the display control unit 105. When the display data DA for one row in the plurality of pixel circuits Aij is stored in the register 310, the display control unit 105 supplies the latch pulse LP to the latch circuit 315.

When the latch pulse LP is supplied from the display control unit 105, the latch circuit 315 holds the display data DA stored in the register 310.

The digital-to-analog converters 320_1 to **320_*m* are connected to the data lines Sj on one-to-one correspondence. For example, a digital-to-analog converter 320_1 is connected to a data line S1 and a digital-to-analog converter 320_2 is connected to a data line S2. The digital-to-analog converters 320_1 to 320_*m* convert the display data DA held in the latch circuit 315** into an analog signal and supplies the analog signal to the corresponding data lines Sj.

The gate driver circuit 40 is a driving circuit for the pixel circuits Aij. The gate driver circuit 40 supplies a scanning signal for selecting a write-target pixel circuit Aij to a scanning line Gi. More specifically, the gate driver circuit 40 includes an n-bit shift register, a logic operation circuit, and n buffers (none of which is illustrated).

The shift register has n registers (not illustrated) connected in cascade. In the shift register, the start pulse YI supplied from the display control unit 105 to a forefront register is sequentially transferred to each stage of registers in synchronization with the clock YCK supplied from the display control unit 105. A timing pulse TP is supplied from each stage of registers to the logic operation circuit, in accordance with a timing when the start pulse YI is supplied to each stage of registers.

The logic operation circuit is provided so as to correspond to each stage of registers and performs a logic operation on the basis of the timing pulse TP supplied from each stage of registers and the timing signal OE supplied from the display control unit 105. The logic operation circuit supplies a voltage, which corresponds to a result of the logic operation, to the scanning lines Gi and the control wires that correspond to the respective stages via buffers provided correspondingly to logic operation circuits of the respective stages.

The display control circuit 10 includes the display control unit 105 and an image data correction circuit 110. The image data correction circuit 110 includes an image data acquisition unit 115, a deterioration amount increment calculation unit 120 (calculation unit), a deterioration amount accumulation unit 125 (accumulation unit), a threshold determination unit 130, a correction unit 135, a storage unit 145, an output data storage unit 150, and an aged deterioration characteristic storage unit 155. The image data correction circuit 110 estimates a deterioration amount of an organic light-emitting element from image data and corrects the image data. The image data is displayed in the display unit 20. The image data acquisition unit 115 acquires image data from external equipment of the display device 1 or the like.

The deterioration amount increment calculation unit 120 refers to, through the storage unit 145, the image data acquired by the image data acquisition unit 115. By using the image data that is referred to, a luminance conversion coefficient (deterioration index), a brightness coefficient (BC coefficient), and a temperature coefficient, the deterioration amount increment calculation unit 120 calculates an increment of the deterioration amount of the organic light-emitting element of each of the pixel circuits Aij of the display unit 20. Specifically, the deterioration amount increment calculation unit 120 calculates the increment of the deterioration amount by using the following formula (1).

$$I=G^{d}\times BC\times TC \quad (1)$$

I is the increment of the deterioration amount, G is gradation, d is the deterioration index, BC is the BC coefficient, and TC is the temperature coefficient. The gradation is gradation indicated by gradation data included in the image data displayed in the display unit 20 and is represented by a value of 0 to 255 with use of higher eight bits of the gradation data. The gradation data is data indicating gradation. The deterioration index is a value for converting the gradation into the deterioration amount and calculated by m×n with use of a gamma coefficient m that is a coefficient indicating a relationship between the gradation and luminance and a coefficient n indicating a relationship between the luminance and the deterioration amount. The gamma coefficient m is typically 2.2. The coefficient n is a value obtained through an experiment and n is preferably 1.5 to 2.0.

The BC coefficient is a coefficient for considering adjustment of luminance of an image in accordance with brightness of a surrounding environment in a place where the display device 1 is installed. In a bright place, for example, such as a place where sunlight is radiated, adjustment to increase luminance of an image is performed in order for a person to easily identify a character or a picture that is displayed in a panel. Moreover, in a dark place, adjustment to reduce luminance of an image is performed in order to lengthen a battery life. A function of adjusting luminance of an image in accordance with brightness of the surrounding environment in the place where the display device 1 is installed is called Brightness Control. A value of the BC coefficient changes by an operation of a user and is subjected to circuit setting so as to be 0.0625 to 1.0. In general, when luminance of a pixel increases, deterioration of the organic light-emitting element easily progresses, and when the luminance of the pixel decreases, deterioration of the organic light-emitting element is difficult to progress.

The temperature coefficient is a coefficient for a temperature around the display device 1. In a case where the organic light-emitting element is lit with constant luminance, when a temperature of the display device 1 itself or the temperature around the display device 1 is high, deterioration of the organic light-emitting element easily progresses. When the temperature of the display device 1 itself or the temperature around the display device 1 is low, deterioration of the organic light-emitting element is difficult to progress. A temperature of an environment where the organic light-emitting element is used is measured by a temperature sensor (not illustrated) provided in the display device 1 and the temperature around the display device 1 is subjected to circuit setting so that a value of the temperature coefficient is 0.0625 to 1.0.

Note that, the deterioration amount increment calculation unit 120 may calculate the increment of the deterioration amount by reflecting a current deterioration amount of the organic light-emitting element of each of the pixel circuits Aij to the increment of the deterioration amount, which is calculated by using the image data that is referred to, the deterioration index, the BC coefficient, and the temperature coefficient.

Moreover, the deterioration amount increment calculation unit 120 may calculate the increment of the deterioration amount of the organic light-emitting element of each of the pixel circuits Aij of the display unit 20 on the basis of gradation of image data that has been corrected by the correction unit 135, and/or information supplied to the display unit 20.

The deterioration amount accumulation unit 125 refers to, through the storage unit 145, the increment of the deterioration amount of the organic light-emitting element of each of the pixel circuits Aij, which is calculated by the deterioration amount increment calculation unit 120. The deterioration amount accumulation unit 125 accumulates the increment of the deterioration amount for each of the pixel circuits Aij. The deterioration amount accumulation unit 125 stores, in the storage unit 145, an accumulated deterioration amount that is accumulated. The accumulated deterioration amount is a total amount of increments of the deterioration amount accumulated by the deterioration amount accumulation unit 125.

Since the deterioration amount accumulation unit 125 accumulates the deterioration amount of the organic light-emitting element, the accumulated deterioration amount of the organic light-emitting element in each of the pixel circuits Aij needs to be stored in the storage unit 145.

However, when the accumulated deterioration amount is stored in the storage unit 145 every frame in all the pixel circuits Aij, data stored in the storage unit 145 becomes enormous. Since a storage region of the storage unit 145 is limited, information is filled in the storage region in a short time and the deterioration amount accumulation unit 125 is not able to accumulate the deterioration amount. In order to accumulate the deterioration amount for a longer time period, information about the accumulated deterioration amount needs to be compressed.

Thus, the deterioration amount accumulation unit 125 is configured to accumulate the deterioration amount every fixed time. For example, when the display device 1 is used for 1000 hours under a condition that the deterioration amount accumulation unit 125 accumulates the deterioration amount every 2 minutes, the number of times of accumulation is 30000 (30×1000). Since $2^{15}$ is 32768, an amount of information about the number of times of accumulation has 15 bits.

Note that, in order to prevent deterioration of the organic light-emitting element of the pixel circuit Aij from being accelerated due to an excessive increase in luminance, when the accumulated deterioration amount calculated by the deterioration amount accumulation unit 125 exceeds a predetermined value, processing of the accumulation may be stopped.

The threshold determination unit 130 refers to, through the storage unit 145, the deterioration amount of the organic light-emitting element of each of the pixel circuits Aij, which is calculated by the deterioration amount increment calculation unit 120. The threshold determination unit 130 determines whether or not a deterioration amount of a certain organic light-emitting element whose deterioration amount is largest among the organic light-emitting elements of the pixel circuits Aij is equal to or more than a first threshold.

The correction unit 135 refers to, through the storage unit 145, the accumulated deterioration amount of the organic light-emitting element of each of the pixel circuits Aij, which is accumulated by the deterioration amount accumulation unit 125, and a relationship between the accumulated deterioration amount and luminance, which is stored in advance in the aged deterioration characteristic storage unit 155. The correction unit 135 corrects image data on the basis of the accumulated deterioration amount accumulated by the deterioration amount accumulation unit 125 and the relationship between the accumulated deterioration amount and luminance, which is stored in advance in the aged deterioration characteristic storage unit 155. Specific description thereof will be given below.

Considered is a case where the same degradation data is supplied to a pixel circuit Aij whose organic light-emitting element is deteriorated and a pixel circuit Aij whose organic light-emitting element is not deteriorated. In this case, luminance of a pixel corresponding to the pixel circuit Aij whose organic light-emitting element is deteriorated is lower than luminance of a pixel corresponding to the pixel circuit Aij whose organic light-emitting element is not deteriorated. The correction unit 135 corrects gradation data included in image data so that a difference between the luminance of the pixel corresponding to the pixel circuit Aij whose organic light-emitting element is deteriorated and the luminance of the pixel corresponding to the pixel circuit Aij whose organic light-emitting element is not deteriorated is eliminated.

The correction unit 135 refers to the relationship between the accumulated deterioration amount and luminance, which is stored in advance in the aged deterioration characteristic storage unit 155, and calculates a correction value in accordance with the accumulated deterioration amount of the organic light-emitting element of each of the pixel circuits Aij. On the basis of the relationship between the accumulated deterioration amount and luminance, which is stored in advance in the aged deterioration characteristic storage unit 155, the correction unit 135 obtains luminance from the accumulated deterioration amount. The correction unit 135 calculates the correction value so as to perform correction by an amount of reduction from the luminance of the pixel corresponding to the pixel circuit Aij (hereinafter, referred to as a first pixel circuit) whose organic light-emitting element is not deteriorated to luminance based on the accumulated deterioration amount of the organic light-emitting element of each pixel circuit Aij (hereinafter, referred to as a second pixel circuit) whose organic light-emitting element is deteriorated. That is, the correction unit 135 calculates the correction value so that the luminance of the pixel corresponding to the first pixel circuit and the luminance of the pixel corresponding to the second pixel circuit are the same. Note that, the correction unit 135 selects the first pixel circuit from among a plurality of first pixel circuits so that luminance of image data in the pixel corresponding to the first pixel circuit and luminance of image data in the pixel corresponding to the second pixel circuit are the same.

For example, consideration is made for a pixel circuit A11 whose organic light-emitting element is not deteriorated and a pixel circuit A12 whose organic light-emitting element is deteriorated. It is assumed that the same color (image data with the same luminance) is displayed in a pixel corresponding to the pixel circuit A11 and a pixel corresponding to the pixel circuit A12. In a case where luminance of the pixel corresponding to the pixel circuit A12 is corrected, the pixel circuit A11 is selected so that luminance of the pixel corresponding to the pixel circuit A11 and the luminance of the pixel corresponding to the pixel circuit A12 are the same.

The correction unit 135 adds the correction value described above to luminance of the pixel corresponding to each of the pixel circuits Aij. That is, for the pixel circuit Aij whose organic light-emitting element is deteriorated, the correction unit 135 performs correction by an amount of reduction of the luminance due to deterioration, and thereby increases the luminance of the pixel.

When the correction unit 135 adds the correction value to the luminance of the pixel corresponding to each of the pixel circuits Aij, the correction unit 135 determines whether or not a maximum value of luminance of a pixel among all pixels is equal to or less than an upper limit value that allows display.

In a case where the maximum value of the luminance of the pixel is equal to or less than the upper limit value that allows display, the correction unit 135 stores the corrected image data in the output data storage unit 150.

In a case where the maximum value of the luminance of the pixel exceeds the upper limit value that allows display, the correction unit 135 calculates a correction value again. In a case where the correction unit 135 calculates a correction value again, the correction unit 135 performs the following processing. The correction unit 135 calculates a correction value so as to correct, in accordance with luminance of a pixel corresponding to a pixel circuit Aij (hereinafter, referred to as a third pixel circuit) whose accumulated deterioration amount is largest, luminance of a pixel corresponding to a pixel circuit Aij (hereinafter, referred to as a fourth pixel circuit) other than the third pixel circuit. That is, the correction unit 135 calculates the correction value so that the luminance of the pixel corresponding to the third pixel circuit and the luminance of the pixel corresponding to the fourth pixel circuit are the same. Note that, the correction unit 135 selects the third pixel circuit from among a plurality of third pixel circuits so that luminance of image data in the pixel corresponding to the third pixel circuit and luminance of image data in the pixel corresponding to the fourth pixel circuit are the same.

For example, consideration is made for a pixel circuit A21 whose accumulated deterioration amount is largest and a pixel circuit A22 which is a pixel circuit other than the pixel circuit A21 whose accumulated deterioration amount is largest. It is assumed that the same color (image data with the same luminance) is displayed in a pixel corresponding to the pixel circuit A21 and a pixel corresponding to the pixel circuit A22. In a case where luminance of the pixel corresponding to the pixel circuit A22 is corrected, the pixel circuit A21 is selected so that luminance of the pixel corresponding to the pixel circuit A21 and the luminance of the pixel corresponding to the pixel circuit A22 are the same.

The correction unit 135 adds the correction value calculated again to luminance of image data. That is, in the case where the maximum value of the luminance of the pixel among all the pixels exceeds the upper limit value that allows display, the luminance of the pixel other than the pixel whose accumulated deterioration amount is largest is reduced in accordance with the luminance of the pixel whose accumulated deterioration amount is largest and a difference of luminance is thereby eliminated (reduced) as a whole. The correction unit 135 stores the corrected image data in the output data storage unit 150.

The display control unit 105 retrieves, from the output data storage unit 150, the image data corrected by the correction unit 135 and supplies the image data to the source driver circuit 30. The image data is the display data DA described above.

(Operations of Display Device 1)

Operations (image data correction method) of the display device 1 will be described with reference to FIG. 3.

First, the image data acquisition unit 115 acquires image data from external equipment or the like (step S105). The image data acquisition unit 115 stores the acquired image data in the storage unit 145 and instructs the deterioration amount increment calculation unit 120 to perform processing.

When the instruction to perform the processing is given from the image data acquisition unit 115, the deterioration amount increment calculation unit 120 refers to, through the storage unit 145, the image data acquired by the image data acquisition unit 115. The deterioration amount increment calculation unit 120 calculates an increment of a deterioration amount of the organic light-emitting element of each of the pixel circuits Aij on the basis of the image data that is referred to (step S110: calculation step). The deterioration amount increment calculation unit 120 stores the calculated increment of the deterioration amount of the organic light-emitting element of each of the pixel circuits Aij in the storage unit 145. The deterioration amount increment calculation unit 120 instructs the deterioration amount accumulation unit 125 to perform the following processing.

When the instruction to perform the processing is given from the deterioration amount increment calculation unit 120, the deterioration amount accumulation unit 125 refers to, through the storage unit 145, the increment of the deterioration amount of the organic light-emitting element of each of the pixel circuits Aij, which is calculated by the deterioration amount increment calculation unit 120. The deterioration amount accumulation unit 125 accumulates the deterioration amount of the organic light-emitting element of each of the pixel circuits Aij on the basis of the increment of the deterioration amount that is referred to (step S115: accumulation step). Specific description thereof will be given below.

The deterioration amount accumulation unit 125 accumulates the deterioration amount every fixed time. First, the deterioration amount accumulation unit 125 determines whether or not a fixed time lapses after accumulation processing is performed last time. For example, in a case where the display device 1 displays an image at 60 frames per second in the display unit 20, when accumulation processing of the deterioration amount is performed at a 2-second interval, the deterioration amount accumulation unit 125 performs next accumulation processing at a 120th frame (60 frames×2 seconds) after the accumulation processing is performed last time. When the deterioration amount accumulation unit 125 determines whether or not the fixed time lapses, the deterioration amount accumulation unit 125 may count the number of frames, or may operate some counter to make determination in accordance with whether or not a count value indicating a designated time is reached.

The deterioration amount accumulation unit 125 stores the accumulated deterioration amount of the organic light-emitting element of each of the pixel circuits Aij, which is accumulated, in the storage unit 145. The deterioration amount accumulation unit 125 instructs the threshold determination unit 130 to perform processing.

When the instruction to perform the processing is given from the deterioration amount accumulation unit 125, the threshold determination unit 130 refers to, through the storage unit 145, the accumulated deterioration amount of the organic light-emitting element of each of the pixel circuits Aij, which is accumulated by the deterioration amount accumulation unit 125. The threshold determination unit 130 determines whether or not a deterioration amount of an organic light-emitting element whose deterioration amount is largest among the light-emitting elements of the pixel circuits Aij is equal to or more than the first threshold (step S120). In a case where the deterioration amount of the organic light-emitting element whose deterioration amount is largest is equal to or more than the first threshold, the threshold determination unit 130 instructs the correction unit 135 to perform processing. In a case where the deterioration amount of the organic light-emitting element whose deterioration amount is largest is less than the first threshold, the threshold determination unit 130 instructs the display control unit 105 to perform processing. When the instruction to perform the processing is given from the threshold determination unit 130, the display control unit 105 refers to, through the storage unit 145, the image data acquired by the image data acquisition unit 115. The display control unit 105 supplies the image data to the source driver circuit 30. The image data is the display data DA described above.

When the instruction to perform the processing is given from the threshold determination unit 130, the correction unit 135 performs processing described as follows. Specifically, the correction unit 135 refers to, through the storage unit 145, the accumulated deterioration amount of the organic light-emitting element of each of the pixel circuits Aij, which is accumulated by the deterioration amount accumulation unit 125, and a relationship between the accumulated deterioration amount and luminance, which is stored in advance in the aged deterioration characteristic storage unit 155. The correction unit 135 corrects the luminance of the pixel corresponding to each of the pixel circuits Aij on the basis of the accumulated deterioration amount accumulated by the deterioration amount accumulation unit 125 and the relationship between the accumulated deterioration amount and luminance, which is stored in advance in the aged deterioration characteristic storage unit 155 (step S125: correction step). The correction unit 135 adds a correction value to the luminance of the pixel corresponding to each of the pixel circuits Aij. Processing of the correction unit 135 here is as described above.

After correcting the luminance of the pixel corresponding to each of the pixel circuits Aij, the correction unit 135 determines whether or not a maximum value of luminance of a pixel among all the pixels is equal to or less than the upper limit value that allows display (step S130). In a case where the maximum value of the luminance of the pixel among all the pixels is equal to or less than the upper limit value that allows display, the method moves to processing of step S140.

In a case where the maximum value of the luminance of the pixel among all the pixels exceeds the upper limit value that allows display, the correction unit 135 corrects the luminance of the pixel corresponding to each of the pixel circuits Aij again (step S135). Processing of the correction unit 135 here is as described above. The correction unit 135 stores the corrected image data in the output data storage unit 150 and instructs the display control unit 105 to perform processing.

When the instruction to perform the processing is given from the correction unit 135, the display control unit 105 retrieves, from the output data storage unit 150, the image data corrected by the correction unit 135 and supplies the image data to the source driver circuit 30. The image data is the display data DA described above. The source driver circuit 30 supplies the display data DA to the display unit 20 and the display unit 20 displays an image (step S140).

Thus, in the display device 1, the deterioration amount accumulation unit 125 accumulates the increment of the deterioration amount every fixed time. Therefore, when considering that information about the deterioration amount is stored in the storage unit 145, the information about the deterioration amount to be stored in the storage unit 145 is able to be reduced. Accordingly, even in a case where the information about the deterioration amount increases when the number of pixels is large, the information about the deterioration amount is able to be continuously stored in the storage unit 145 for a long time period. As a result, the display device 1 is able to correct image data for a long time period even when the number of pixels is large.

Moreover, in the display device 1, after correcting the luminance of the pixel, in the case where the maximum value of the luminance of the pixel is equal to or less than the upper limit value that allows display, the correction unit 135 corrects the luminance of the pixel whose organic light-emitting element is deteriorated in accordance with the luminance of the pixel whose organic light-emitting element is not deteriorated. As a result, it is possible to reduce a difference of the luminance as a whole in accordance with the luminance of the pixel whose organic light-emitting element is not deteriorated.

Moreover, after correcting the luminance of the pixel, in the case where the maximum value of the luminance of the pixel exceeds the upper limit value, the correction unit 135 corrects the luminance of the pixel other than the pixel whose accumulated deterioration amount accumulated by the deterioration amount accumulation unit 125 is largest, in accordance with the luminance of the pixel whose accumulated deterioration amount is largest. As a result, it is possible to reduce a difference of the luminance as a whole in accordance with the luminance of the pixel whose deterioration amount is largest even when a maximum value of the corrected luminance exceeds the upper limit value that allows display.

Embodiment 2

Figure 4:
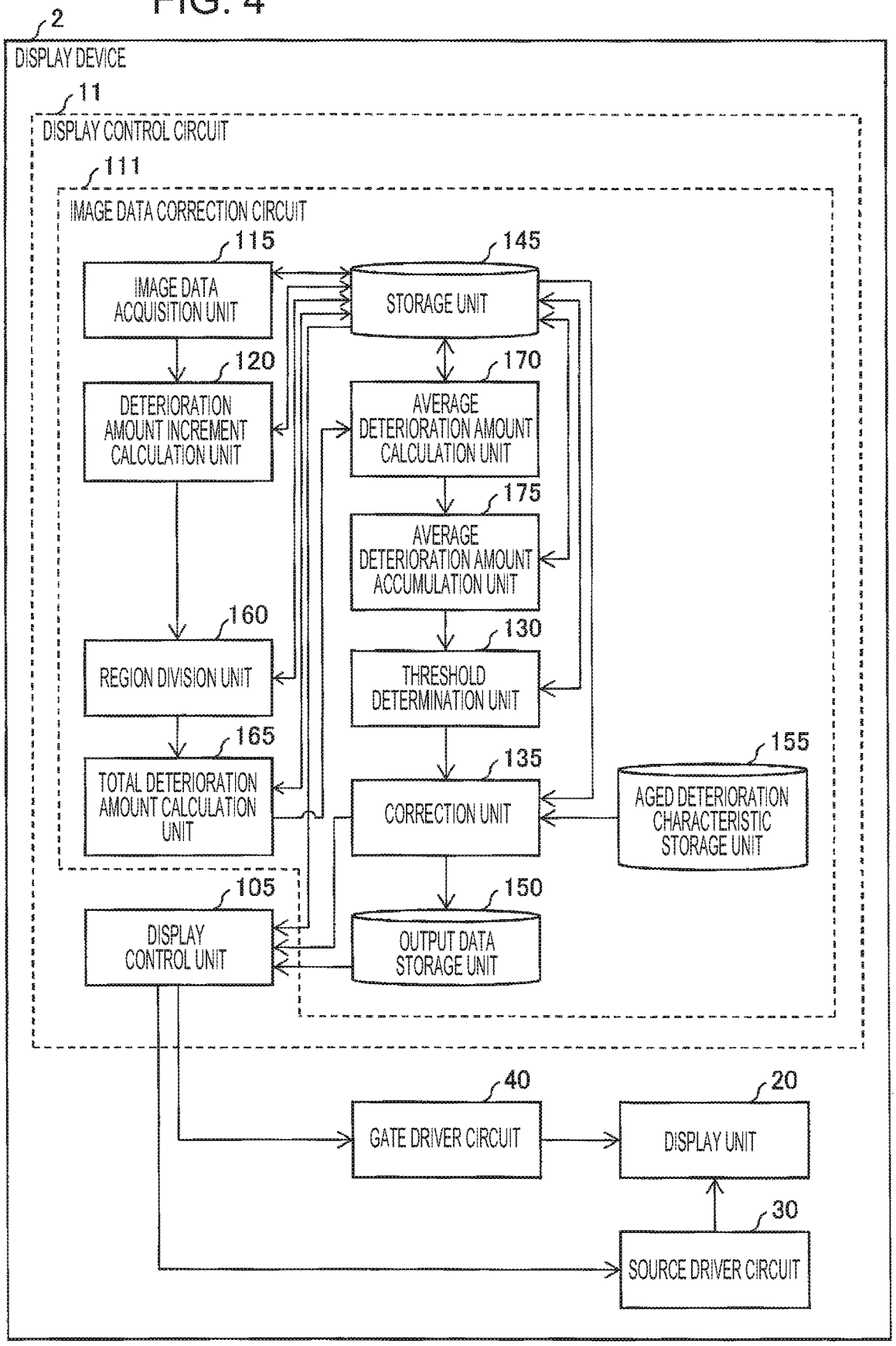
FIG. 4 is a block diagram illustrating a configuration of a display device according to Embodiment 2 of the invention.
Figure 5:
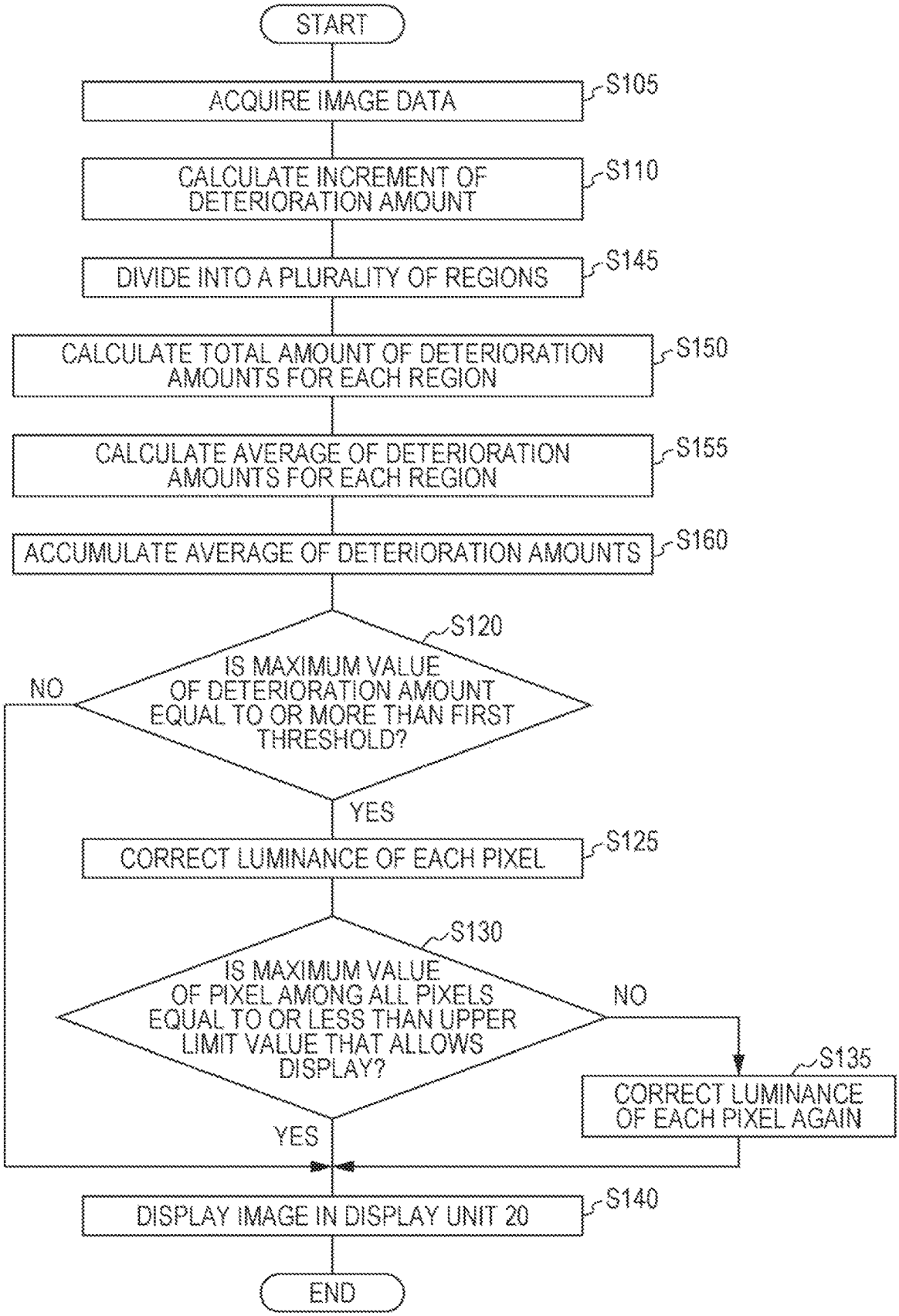
FIG. 5 is a flowchart illustrating operations of the display device illustrated in FIG. 4.

Another embodiment of the invention will be described as follows with reference to FIGS. 4 to 6. Note that, for convenience of description, a member having the same function as that of the member described in the aforementioned embodiment will be given the same reference sign and description thereof will be omitted. FIG. 4 is a block diagram illustrating a configuration of a display device 2 according to Embodiment 2 of the invention. FIG. 5 is a flowchart illustrating operations of the display device 2. FIGS. 6A to 6D are schematic views illustrating one region 205 when a display surface of the display unit 20 is divided into a plurality of regions.

(Configuration of Display Device 2)

As illustrated in FIG. 4, the display device 2 is different from the display device 1 in that the display control circuit 10 is changed to a display control circuit 11. The display control circuit 11 is different from the display control circuit 10 in that the image data correction circuit 110 is changed to an image data correction circuit 111. The image data correction circuit 111 is different from the image data correction circuit 110 in terms of including a region division unit 160, a total deterioration amount calculation unit 165, an average deterioration amount calculation unit 170, and an average deterioration amount accumulation unit 175 (average accumulation unit) but not including the deterioration amount accumulation unit 125.

The region division unit 160 divides the display surface of the display unit 20 into a plurality of regions 205. In sub-pixels that are adjacent, a difference of gradation is small so that a difference of the accumulated deterioration amount is considered to be also small. Thus, consideration is made tor that the display surface of the display unit 20 is divided into the regions 205 each including a plurality of pixels. Here, for example, as illustrated in FIG. 6B, a case where one region 205 includes pixels of 4 rows×4 columns is considered. The region division unit 160 stores information about a boundary of the regions 205 in the storage unit 145.

On the basis of gradation data included in image data displayed in the display unit 20, the total deterioration amount calculation unit 165 calculates a total increment of deterioration amounts of organic light-emitting elements provided in pixel circuits Aij corresponding to sixteen pixels included in one region. The total deterioration amount calculation unit 165 stores the calculated total in the storage unit 145.

The average deterioration amount calculation unit 170 refers to, through the storage unit 145, the total calculated by the total deterioration amount calculation unit 165. The average deterioration amount calculation unit 170 divides the total by the number of pixels (here, sixteen) included in one region and thereby calculates an average of the increments of the deterioration amounts of the organic light-emitting elements corresponding to the sixteen pixels included in one region. The average deterioration amount calculation unit 170 stores the calculated average in the storage unit 145.

The average deterioration amount accumulation unit 175 refers to, through the storage unit 145, the average calculated by the average deterioration amount calculation unit 170. The average deterioration amount accumulation unit 175 accumulates the average for each of the regions 205. The average deterioration amount accumulation unit 175 stores the average accumulated deterioration amount, which is accumulated, in the storage unit 145.

The correction unit 135 refers to the average accumulated deterioration amount which is accumulated by the average deterioration amount accumulation unit 175 and stored in the storage unit 145 and a relationship between the accumulated deterioration amount and luminance, which is stored in advance in the aged deterioration characteristic storage unit 155. On the basis of the relationship between the accumulated deterioration amount and luminance, which is stored in advance in the aged deterioration characteristic storage unit 155, the correction unit 135 obtains luminance from the accumulated deterioration amount. The correction unit 135 calculates a correction value for each of the pixels in accordance with the average accumulated deterioration amount of each of the regions 205. That is, a correction value is calculated for each of pixels belonging to one region 205 in accordance with an average accumulated deterioration amount of the region 205. Specifically, the correction unit 135 calculates the correction value so as to perform correction by an amount of reduction from luminance of a pixel corresponding a region 205 where an organic light-emitting element is not deteriorated to luminance based on an average accumulated deterioration amount of a region 205 where an organic light-emitting element is deteriorated. That is, the correction unit 135 calculates the correction value so that luminance of a pixel corresponding to a pixel circuit Aij (hereinafter, referred to as a fifth pixel circuit) in the region 205 where the organic light-emitting element is not deteriorated and luminance of a pixel corresponding to a pixel circuit Aij (hereinafter, referred to as a sixth pixel circuit) in the region 205 where the organic light-emitting element is deteriorated are the same. Note that, the correction unit 135 selects the fifth pixel circuit so that the luminance of image data in the pixel corresponding to the fifth pixel circuit and the luminance of image data in the pixel corresponding to the sixth pixel circuit are the same. The correction unit 135 adds the correction value to luminance of all pixels in the region 205 where the organic light-emitting element is deteriorated. That is, the correction unit 135 performs correction for each of the regions 205 by an amount of reduction of the luminance due to deterioration, and thereby increases the luminance of the pixels in the region 205.

When the correction unit 135 adds the correction value to the luminance of the pixels in each of the regions 205, the correction unit 135 determines whether or not a maximum value of luminance of a pixel among all the pixels is equal to or less than the upper limit value that allows display. Processing performed after the determination processing in processing performed by the correction unit 135 is similar to the processing performed by the correction unit 135 of the display device 1.

When the correction unit 135 corrects image data, the correction unit 135 calculates the correction value assuming that each of organic light-emitting elements of the sixteen pixels included in one region have the same accumulated deterioration amount. That is, it is assumed that the accumulated deterioration amount in one region is the average accumulated deterioration amount accumulated by the average deterioration amount accumulation unit 175. As a result, whereas the correction value is calculated in each of all the pixels, the correction value is calculated for one region, so that an amount of information about the accumulated deterioration amount becomes 1/16.

(Operations of Display Device 2)

Operations of the display device 2 will be described with reference to FIG. 5. As illustrated in FIG. 5, the operations of the display device 2 are different from the operations of the display device 1 in that processing of step S145 to step S160 is added and the processing of step S115 is omitted. Here, only a different part of the operations of the display device 2 from the operations of the display device 1 will be described.

After the processing of step S110, the deterioration amount increment calculation unit 120 instructs the region division unit 160 to perform the following processing. When the instruction to perform the processing is given from the deterioration amount increment calculation unit 120, the region division unit 160 divides the display surface of the display unit 20 into a plurality of regions 205 (step S145: region division step). The region division unit 160 stores information about a boundary of the regions 205 in the storage unit 145 and instructs the total deterioration amount calculation unit 165 to perform processing.

When the instruction to perform the processing is given from the region division unit 160, the total deterioration amount calculation unit 165 refers to, through the storage unit 145, the deterioration amount of the organic light-emitting element of each of the pixel circuits Aij of the display unit 20, which is calculated by the deterioration amount increment calculation unit 120. On the basis of the deterioration amount calculated by the deterioration amount increment calculation unit 120, the total deterioration amount calculation unit 165 calculates a total deterioration amount for each of the regions 205 (step S150: total deterioration amount calculation step). The total deterioration amount calculation unit 165 stores the calculated total in the storage unit 145 and instructs the average deterioration amount calculation unit 170 to perform processing.

When the instruction to perform the processing is given from the total deterioration amount calculation unit 165, the average deterioration amount calculation unit 170 refers to, through the storage unit 145, the total calculated by the total deterioration amount calculation unit 165. The average deterioration amount calculation unit 170 divides the total by the number of pixels (here, sixteen) included in one region and thereby calculates an average of increments of the deterioration amounts of the sixteen pixels included in one region (step S155: average deterioration amount calculation step). The average deterioration amount calculation unit 170 stores the calculated average in the storage unit 145 and instructs the average deterioration amount accumulation unit 175 to perform processing.

When the instruction to perform the processing is given from the average deterioration amount calculation unit 170, the average deterioration amount accumulation unit 175 refers to, through the storage unit 145, the average calculated by the average deterioration amount calculation unit 170. The average deterioration amount accumulation unit 175 accumulates the average of deterioration amounts for each of the regions 205 (step S160: average accumulation step). The average deterioration amount accumulation unit 175 stores the average accumulated deterioration amount, which is accumulated, in the storage unit 145 and instructs the threshold determination unit 130 to perform processing.

When the instruction to perform the processing is given from the average deterioration amount accumulation unit 175, the threshold determination unit 130 refers to, through the storage unit 145, the average of the deterioration amounts for each of the regions 205, which is accumulated by the average deterioration amount accumulation unit 175. The threshold determination unit 130 determines whether or not an average accumulated deterioration amount of a region 205 where the average accumulated deterioration amount is largest among the regions 205 is equal to or more than the first threshold (step S120). In a case where the average accumulated deterioration amount of the region 205 where the average accumulated deterioration amount is largest is equal to or more than the first threshold, the threshold determination unit 130 instructs the correction unit 135 to perform processing. In a case where the average accumulated deterioration amount of the region 205 where the average accumulated deterioration amount is largest is less than the first threshold, the threshold determination unit 130 instructs the display control unit 105 to perform processing.

When the instruction to perform the processing is given from the threshold determination unit 130, the correction unit 135 refers to the average accumulated deterioration amount which is accumulated by the average deterioration amount accumulation unit 175 and stored in the storage unit 145 and a relationship between the accumulated deterioration amount and luminance, which is stored in advance in the aged deterioration characteristic storage unit 155. In accordance with the average accumulated deterioration amount in each of the regions 205, the correction unit 135 calculates a correction value for each of the regions 205. On the basis of the average accumulated deterioration amount accumulated by the average deterioration amount accumulation unit 175 and the relationship between the accumulated deterioration amount and luminance, which is stored in advance in the aged deterioration characteristic storage unit 155, the correction unit 135 corrects luminance of pixels in each of the regions 205 (step S125). The correction unit 135 adds a correction value to the luminance of the pixels in each of the regions 205. The processing of the correction unit 135 here is as described above. Processing after step S130 is similar to that of the display device 1.

Thus, in the display device 2, the average deterioration amount accumulation unit 175 accumulates the average of the increments of the deterioration amounts of organic light-emitting elements for each of regions. Therefore, an accumulation amount of the deterioration amount is smaller than that in a case where the increment of the deterioration amount is accumulated for each of pixels. When considering that information about the deterioration amount is stored in the storage unit 145, the information about the deterioration amount to be stored in the storage unit 145 is able to be reduced. Accordingly, even in a case where the information about the deterioration amount increases when the number of pixels is large, the information about the deterioration amount is able to be continuously stored in the storage unit 145 for a long time period. As a result, the display device 2 is able to correct image data for a long time period even when the number of pixels is large.

(Modification)

Note that, when the number of sub-pixels included in one region 205 increases, it is considered that a boundary of regions and a portion where a difference of gradation in a displayed image is great are different and an error of correction is noticeable. In order to make the error less noticeable, a white pixel W1 and a black pixel B1 are alternately arranged as illustrated in FIGS. 6A to 6D. Specifically, luminance of the white pixel W1 and luminance of the black pixel B1 are separately managed. In the white pixel W1 and the black pixel B1, the respective pixels are merely represented by white or black for ease of description, and there is no particular meaning in that the pixels are white or black. Here, an average accumulated deterioration amount of the white pixel W1 and an average accumulated deterioration amount of the black pixel B1 are separately calculated. FIGS. 6A to 6D illustrate some examples. A table 1 indicates a compression ratio of an average accumulated deterioration amount.

TABLE 1

| | 3 × 3 | 4 × 4 | 5 × 5 | 6 × 6 |
|---|---|---|---|---|
| Number of white pixels | 5 | 8 | 13 | 18 |
| Number of black pixels | 4 | 8 | 12 | 18 |
| Compression ratio | 1/4.5 | 1/8 | 1/12.5 | 1/18 |

Figure 6A:
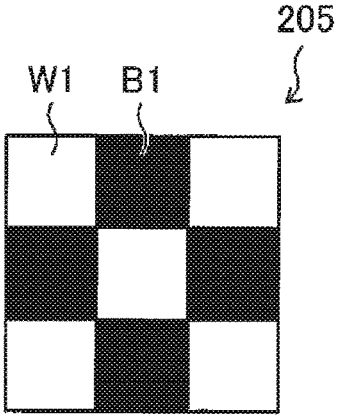
FIGS. 6A to 6D are schematic views each illustrating one region when a display surface of a display unit is divided into a plurality of regions.
Figure 6B:
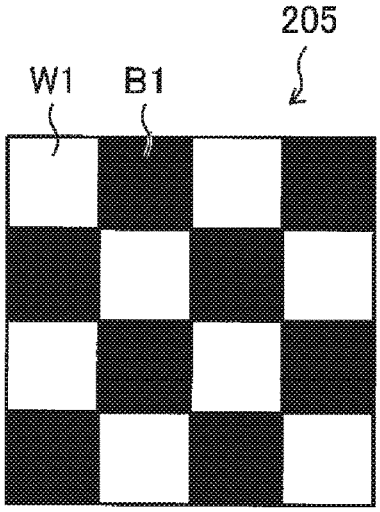

A case where the region 205 includes pixels of 3 rows×3 columns as illustrated in FIG. 6A will be described. In this case, the number of white pixels W1 is 5 and the number of black pixels 131 is 4, Thus, compared to a case where the accumulated deterioration amount is calculated for each of pixels without division into regions, the amount of information about the accumulated deterioration amount becomes $2\times 1/9=1/4.5$.

A case where the region 205 includes pixels of 4 rows×4 columns as illustrated in FIG. 6B will be described. In this case, the number of white pixels W1 is 8 and the number of black pixels B1 is 8. Thus, compared to the case where the accumulated deterioration amount is calculated for each of pixels without division into regions, the amount of information about the accumulated deterioration amount becomes $2\times 1/16=1/8$.

Figure 6C:
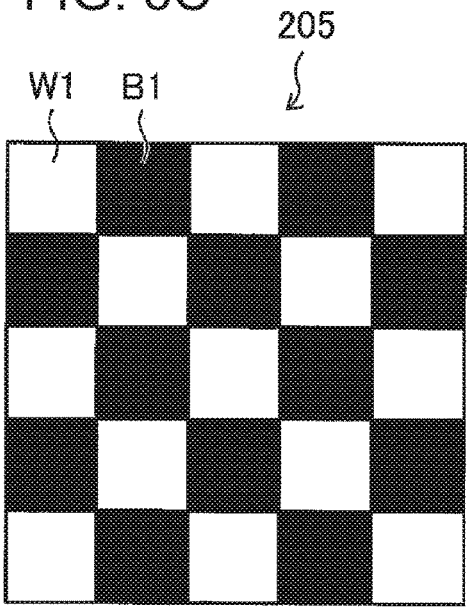

A case where the region 205 includes pixels of 5 rows×5 columns as illustrated in FIG. 6C will be described. In this case, the number of white pixels W1 is 13 and the number of black pixels B1 is 12. Thus, compared to the case where the accumulated deterioration amount is calculated for each of pixels without division into regions, the amount of information about the accumulated deterioration amount becomes $2\times 1/25=1/12.5$.

Figure 6D:
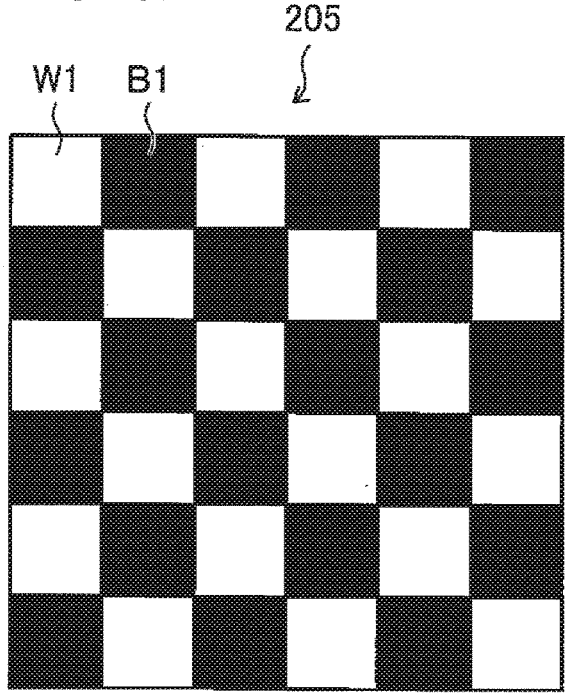

A case where the region 205 includes pixels of 6 rows×6 columns as illustrated in FIG. 6D will be described. In this case, the number of white pixels W1 is 18 and the number of black pixels B1 is 18. Thus, compared to the case where the accumulated deterioration amount is calculated for each of pixels without division into regions, the amount of information about the accumulated deterioration amount becomes $2\times 1/36=1/18$.

Since the average accumulated deterioration amount of the white pixel W1 and the average accumulated deterioration amount of the black pixel B1 are calculated, the amount of information about the average accumulated deterioration amount becomes about twice as compared to a case where the average accumulated deterioration amount is calculated simply for each of regions 205, but an error after correction is able to be prevented from being noticeable. A problem that the error after correction is noticeable will be specifically described below with reference to FIG. 7.

Figure 7:
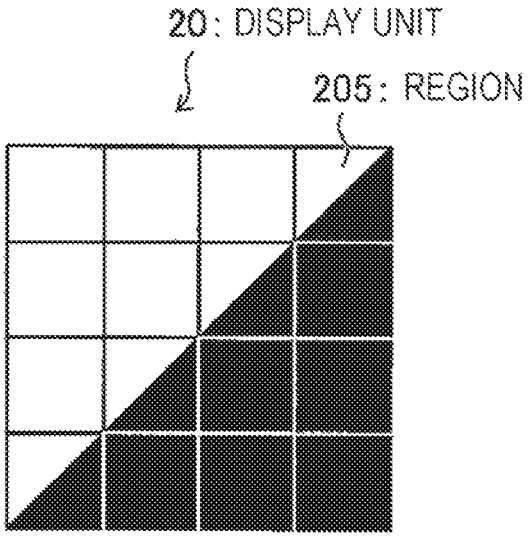
FIG. 7 illustrates a state where an image is displayed in the display unit.

FIG. 7 illustrates a state where an image is displayed in the display unit 20. In FIG. 7, an upper-left half part of the display unit 20 is displayed in white and a lower-right half part of the display unit 20 is displayed in blue. In the display unit 20, a region 205 that corresponds to an s-th row and corresponds to a t-th column is denoted as a region (s, t). It is assumed that numbers of s and t are reduced toward an upper left side in FIG. 7.

A deterioration ratio of a region 205 (for example, region (1, 1)) displayed in white is set as, for example, (deterioration ratio of R, deterioration ratio of G, deterioration ratio of B)=(20%, 20%, 20%). R indicates a sub-pixel of red, G indicates a sub-pixel of green, and B indicates a sub-pixel of blue.

A deterioration ratio of a region 205 (for example, region (4, 4)) displayed in blue is set as, for example, (deterioration ratio of R, deterioration ratio of G, deterioration ratio of B)=(0%, 0%, 20%).

A deterioration ratio of a region 205 (for example, region (3, 2)) including both a part displayed in white and a part displayed in blue is set as, for example, (deterioration ratio of R, deterioration ratio of G, deterioration ratio of B)=(10%, 10%, 20%).

Moreover, in a case where an image in which all gradations of R, G, and B are 100, for example, is displayed in all regions 205 of the display unit 20, the gradation of a sub-pixel that is most deteriorated is 80, so that the gradations of all the regions 205 are corrected to be 80.

The corrected gradation of the region 205 (for example, region (1, 1)) displayed in white is (gradation of R, gradation of G, gradation of B)=(80/(1.0−0.2), 80/(1.0−0.2), 80/(1.0−0.2))=(100, 100, 100).

The corrected gradation of the region 205 (for example, region (4, 4)) displayed in blue is (gradation of R, gradation of G, gradation of B)=(80/(1.0−0.0), 80/(1.0−0.0), 80/(1.0−0.2))=(80, 80, 100).

The gradation of the region 205 (for example, region (3, 2)) including both the part displayed in white and the part displayed in blue is (gradation of R, gradation of G, gradation of B)=(80/(1.0−0.1), 80/(1.0−0.1), 80/(1.0−0.2))=(89, 89, 100).

The gradation of an actually displayed image is indicated below on the basis of data of the corrected gradation.

The actual gradation of the region 205 (for example, region (1, 1)) displayed in white is (gradation of R, gradation of G, gradation of B)=(100×(1.0−0.2), 100×(1.0−0.2), 100×(1.0−0.2))=(80, 80, 80).

The actual gradation of the region 205 (for example, region (1, 1)) displayed in blue is (gradation of R, gradation of G, gradation of B)=(80×(1.0−0.0), 80×(1.0−0.0), 100×(1.0−0.2))=(80, 80, 80).

In the region 205 (for example, region (3, 2)) including both the part displayed in white and the part displayed in blue, the actual gradation of the part displayed in white is (gradation of R, gradation of G, gradation of B)=(89×(1.0−0.2), 89×(1.0−0.2), 100×(1.0−0.2))=(71, 71, 80).

In the region 205 (for example, region (3, 2)) including both the part displayed in white and the part displayed in blue, the actual gradation of the part displayed in blue is (gradation of R, gradation of G, gradation of B)=(89×(1.0−0.0), 89×(1.0−0.0), 100×(1.0−0.2))=(89, 89, 80).

Thus, there is a case where the gradation is not 80 in the region 205 (for example, region (3, 2)) including both the part displayed in white and the part displayed in blue. However, as described above, by separately calculating the average accumulated deterioration amount of the white pixel W1 and the average accumulated deterioration amount of the black pixel B1, a problem that an error after correction is noticeable is able to be prevented. Specific description thereof will be given below. When the average deterioration amount is accumulated for each of the regions 205 and luminance of pixels in the region 205 is corrected, a boundary line is displayed at a boundary between regions 205 due to an error after correction. Thus, by separately calculating the average accumulated deterioration amount of the white pixel W1 and the average accumulated deterioration amount of the black pixel B1 in the region 205, average accumulated deterioration amounts are separately calculated between adjacent pixels in the regions 205, which are in contact with the boundary between the regions 205. As a result, different colors are alternately arrayed between the adjacent pixels in the regions 205, which are in contact with the boundary between the regions 205, thus making it possible to prevent the boundary line from being displayed at the boundary between the regions 205.

Embodiment 3

Figure 8:
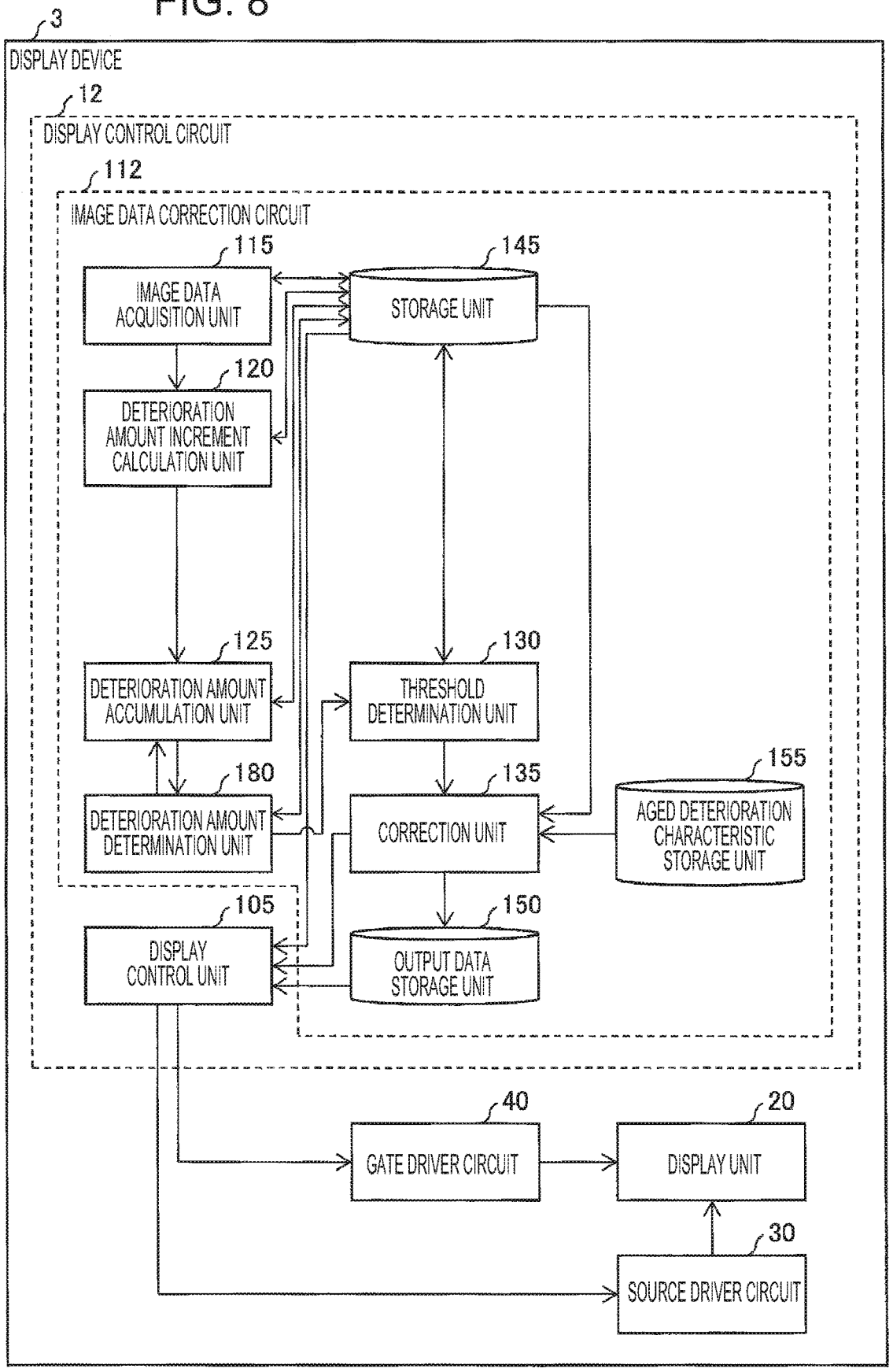
FIG. 8 is a block diagram illustrating a configuration of a display device according to Embodiment 3 of the invention.
Figure 9:
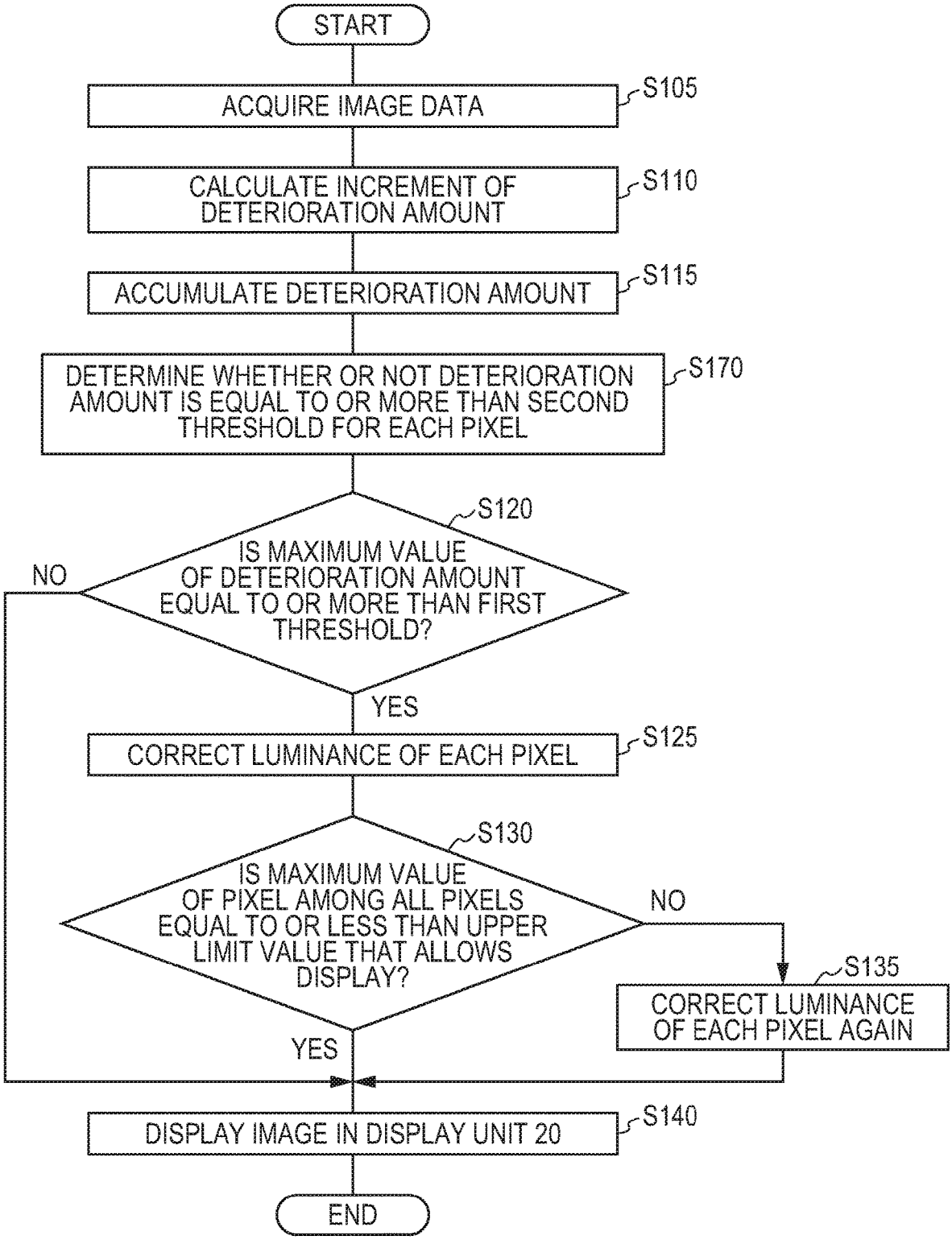
FIG. 9 is a flowchart illustrating operations of the display device illustrated in FIG. 8.

Another embodiment of the invention will be described as follows with reference to FIGS. 8 and 9. Note that, for convenience of description, a member having the same function as that of the member described in the aforementioned embodiments will be given the same reference sign and description thereof will be omitted. FIG. 8 is a block diagram illustrating a configuration of a display device 3 according to Embodiment 3 of the invention. FIG. 9 is a flowchart illustrating operations of the display device 3.

(Configuration of Display Device 3)

As illustrated in FIG. 8, the display device 3 is different from the display device 1 in that the display control circuit 10 is changed to a display control circuit 12. The display control circuit 12 is different from the display control circuit 10 in that the image data correction circuit 110 is changed to an image data correction circuit 112. The image data correction circuit 112 is different from the image data correction circuit 110 in terms of including a deterioration amount determination unit 180.

After the display device 3 operates for a fixed time, the deterioration amount determination unit 180 refers to, through the storage unit 145, the deterioration amount of the organic light-emitting element of each of the pixel circuits Aij, which is accumulated by the deterioration amount accumulation unit 125. The deterioration amount determination unit 180 determines, for each of pixels corresponding to the pixel circuits Aij, whether the deterioration amount of the organic light-emitting element is equal to or more than a second threshold. The deterioration amount determination unit 180 instructs the deterioration amount accumulation unit 125 to perform accumulation of the deterioration amount only for a pixel whose deterioration amount is determined to be equal to or more than the second threshold and a peripheral region of the pixel. The peripheral region may be, for example, a region of the pixel whose deterioration amount is determined to be equal to or more than the second threshold and three pixels adjacent thereto.

The deterioration amount accumulation unit 125 is instructed by the deterioration amount determination unit 180 to perform, from a next frame, accumulation of the deterioration amount only for a pixel whose deterioration amount is determined to be equal to or more than the second threshold and a peripheral region of the pixel. In accordance with the instruction, the deterioration amount accumulation unit 125 performs accumulation of the deterioration amount only for the pixel whose deterioration amount is determined to be equal to or more than the second threshold and the peripheral region of the pixel.

Note that, though the deterioration amount only for the pixel whose deterioration amount is determined to be equal to or more than the second threshold and the peripheral region of the pixel is accumulated here, the number of times of accumulation of the deterioration amount for the pixel and the peripheral region of the pixel may be greater than the number of times of accumulation of the deterioration amount for the other region.

For example, in a screen of a smartphone or the like, an icon is always displayed in an upper part of the screen and an organic light-emitting element is more easily deteriorated in the upper part of the screen where the icon is displayed than the other display region. Thus, by calculating the accumulated deterioration amount for each of pixels only in a region of an upper end and/or a lower end of the screen, information about the accumulated deterioration amount to be stored in the storage unit 145 is able to be reduced. Since the information about the accumulated deterioration amount is able to be reduced, even when an interval of a time at which the deterioration amount is accumulated is short, deterioration is able to be corrected for a long time period and resolution and accuracy are able to be improved.

(Operations of Display Device 3)

Operations of the display device 3 will be described with reference to FIG. 9. As illustrated in FIG. 9, the operations of the display device 3 are different from the operations of the display device 1 in that processing of step S170 is added.

After the processing of step S115, the deterioration amount accumulation unit 125 instructs the deterioration amount determination unit 180 to perform processing.

When the instruction to perform the processing is given from the deterioration amount accumulation unit 125, the deterioration amount determination unit 180 refers to, through the storage unit 145, the deterioration amount of the organic light-emitting element of each of the pixel circuits Aij, which is accumulated by the deterioration amount accumulation unit 125. The deterioration amount determination unit 180 determines whether or not the deterioration amount is equal to or more than the second threshold for each of the pixels (step S170). The deterioration amount determination unit 180 instructs the deterioration amount accumulation unit 125 to perform, from a next frame, accumulation of the deterioration amount only for a pixel whose deterioration amount is determined to be equal to or more than the second threshold and a peripheral region of the pixel. The deterioration amount determination unit 180 instructs the threshold determination unit 130 to perform processing. Processing after step S120 is similar to that of the display device 1.

Embodiment 4

Figure 10:
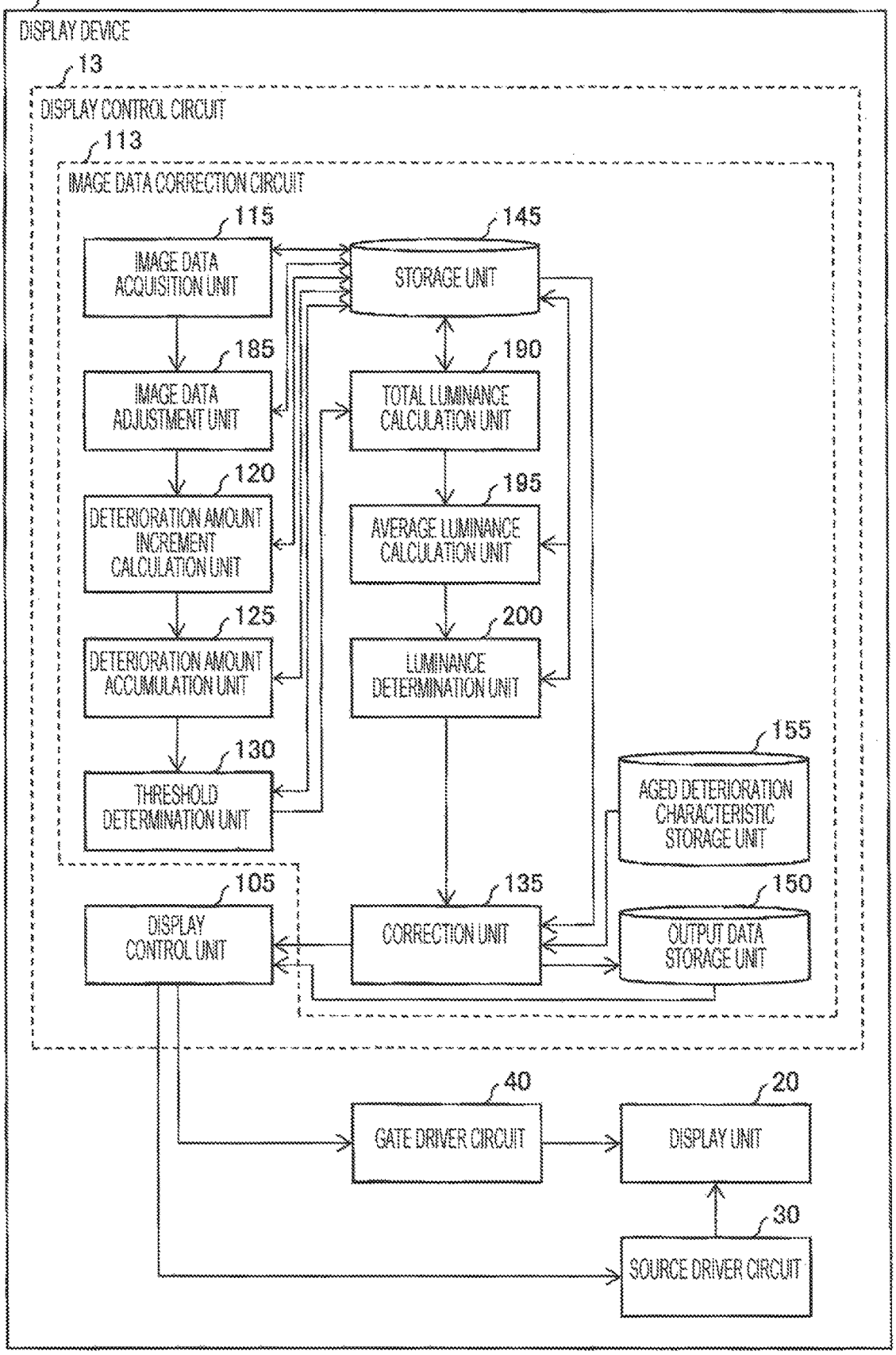
FIG. 10 is a block diagram illustrating a configuration f a display device according to Embodiment 4 of the invention.
Figure 11:
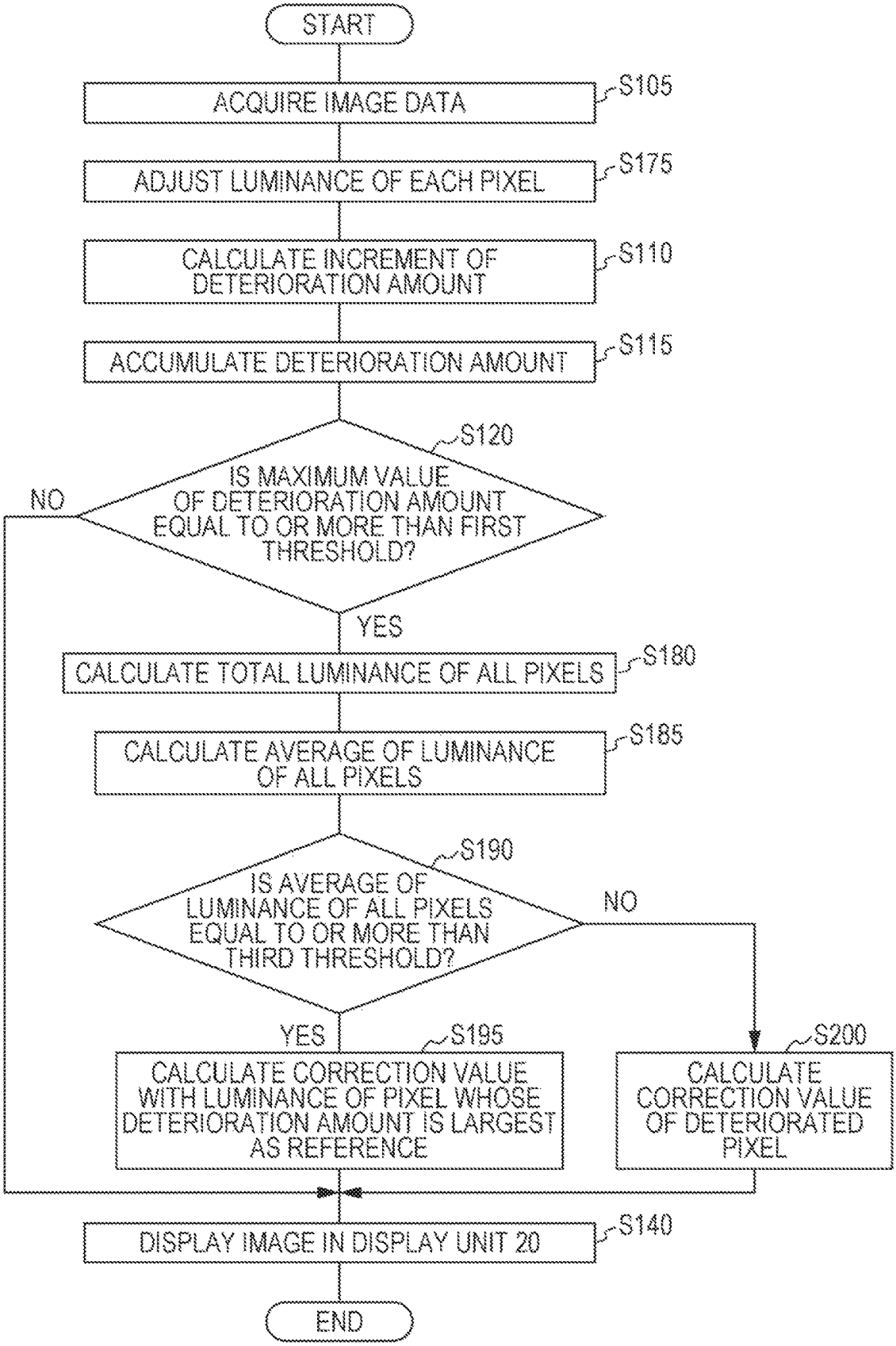
FIG. 11 is a flowchart illustrating operations of the display device illustrated in FIG. 10.

Another embodiment of the invention will be described as follows with reference to FIGS. 10 and 11. Note that, for convenience of description, a member having the same function as that of the member described in the aforementioned embodiments will be given the same reference sign and description thereof will be omitted. FIG. 10 is a block diagram illustrating a configuration of a display device 4 according to Embodiment 4 of the invention. FIG. 11 is a flowchart illustrating operations of the display device 4.

(Configuration of Display Device 4)

As illustrated in FIG. 10, the display device 4 is different from the display device 1 in that the display control circuit 10 is changed to a display control circuit 13. The display control circuit 13 is different from the display control circuit 10 in that the image data correction circuit 110 is changed to an image data correction circuit 113. The image data correction circuit 113 is different from the image data correction circuit 110 in terms of including an image data adjustment unit 185 (adjustment unit), a total luminance calculation unit 190 (average calculation unit), an average luminance calculation unit 195 (average calculation unit), and a luminance determination unit 200.

The image data adjustment unit 185 has the function of Brightness Control described above and adjusts luminance of a pixel in accordance with brightness of a surrounding environment in a place where the display device 4 is installed. The image data adjustment unit 185 stores the adjusted luminance of the pixel in the storage unit 145.

The total luminance calculation unit 190 refers to, through the storage unit 145, the luminance of the pixel, which is adjusted by the image data adjustment unit 185. On the basis of the luminance of the pixel adjusted by the image data adjustment unit 185, the total luminance calculation unit 190 calculates total luminance of all pixels. The total luminance calculation unit 190 stores the calculated total in the storage unit 145.

The average luminance calculation unit 195 refers to, through the storage unit 145, the total calculated by the total luminance calculation unit 190. The average luminance calculation unit 195 divides the total by the number of all the pixels and thereby calculates an average of the luminance of all the pixels. The average luminance calculation unit 195 stores the calculated average in the storage unit 145.

The luminance determination unit 200 refers to, through the storage unit 145, the average calculated by the average luminance calculation unit 195. The luminance determination unit 200 determines whether or not the average calculated by the average luminance calculation unit 195 is equal to or more than a third threshold (predetermined threshold). The luminance determination unit 200 stores a determination result in the storage unit 145.

In a case where the luminance determination unit 200 determines that the average of the luminance of all the pixels is equal to or more than the third threshold, the correction unit 135 performs processing described below. The correction unit 135 calculates a correction value so as to correct, in accordance with luminance of a pixel corresponding to a pixel circuit Aij (hereinafter, referred to as a seventh pixel circuit) whose accumulated deterioration amount is largest, luminance of a pixel corresponding to a pixel circuit Aij (hereinafter, referred to as an eighth pixel circuit) other than the seventh pixel circuit. That is, the correction unit 135 calculates the correction value so that the luminance of the pixel corresponding to the seventh pixel circuit and the luminance of the pixel corresponding to the eighth pixel circuit are the same. Note that, the correction unit 135 selects the seventh pixel circuit so that luminance of image data in the pixel corresponding to the seventh pixel circuit and luminance of image data in the pixel corresponding to the eighth pixel circuit are the same. The correction unit 135 adds the correction value to luminance of a pixel corresponding to each of the pixel circuits Aij. That is, when the average of the luminance of all the pixels is equal to or more than the third threshold, in accordance with luminance of a pixel whose accumulated deterioration amount is largest, luminance of a pixel other than the pixel whose accumulated deterioration amount is largest is reduced, so that a difference of luminance is reduced as a whole.

On the other hand, in a case where the luminance determination unit 200 determines that the average of the luminance of all the pixels is less than the third threshold, the correction unit 135 performs processing described below. The correction unit 135 calculates the correction value so as to perform correction by an amount of reduction from luminance of a pixel corresponding to a pixel circuit Aij (hereinafter, referred to as a ninth pixel circuit) whose organic light-emitting element is not deteriorated to luminance based on the accumulated deterioration amount of the organic light-emitting element of each pixel circuit Aij (hereinafter, referred to as a tenth pixel circuit) whose organic light-emitting element is deteriorated. That is, the correction unit 135 calculates the correction value so that the luminance of the pixel corresponding to the ninth pixel circuit and the luminance of the pixel corresponding to the tenth pixel circuit are the same. Note that, the correction unit 135 selects the ninth pixel circuit so that luminance of image data in the pixel corresponding to the ninth pixel circuit and luminance of image data in the pixel corresponding to the tenth pixel circuit are the same. The correction unit 135 adds the correction value to luminance of the pixel corresponding to each of the pixel circuits Aij.

(Operations of Display Device 4)

Operations of the display device 4 will be described with reference to FIG. 11. As illustrated in FIG. 11, the operations of the display device 4 are different from the operations of the display device 1 in that processing of step S175 and step S180 to step S200 is added.

The image data acquisition unit 115 instructs the image data adjustment unit 185 to perform processing. When the instruction to perform the processing is given from the image data acquisition unit 115, the image data adjustment unit 185 adjusts luminance of a pixel in accordance with brightness of the surrounding environment in the place where the display device 1 is installed (step S175). The image data adjustment unit 185 stores the adjusted luminance of the pixel in the storage unit 145. The image data adjustment unit 185 instructs the deterioration amount increment calculation unit 120 to perform processing. After that, the processing of step S110 to step S120 is performed.

After the processing of step S120, in a case where the deterioration amount of the organic light-emitting element whose deterioration amount is largest is equal to or more than the first threshold, the threshold determination unit 130 instructs the total luminance calculation unit 190 to perform processing. In a case where the deterioration amount of the organic light-emitting element whose deterioration amount is largest is less than the first threshold, the threshold determination unit 130 instructs the display control unit 105 to perform processing.

When the instruction to perform the processing is given from the threshold determination unit 130, the total luminance calculation unit 190 refers to, through the storage unit 145, the deterioration amount of the organic light-emitting element of each of the pixel circuits Aij, which is accumulated by the deterioration amount accumulation unit 125. The total luminance calculation unit 190 calculates total luminance of all pixels (step S180). The total luminance calculation unit 190 stores the calculated total in the storage unit 145. The total luminance calculation unit 190 instructs the average luminance calculation unit 195 to perform processing.

When the instruction to perform the processing is given from the total luminance calculation unit 190, the average luminance calculation unit 195 refers to, through the storage unit 145, the total calculated by the total luminance calculation unit 190. The average luminance calculation unit 195 divides the total by the number of all the pixels and thereby calculates an average of luminance of all the pixels (step S185). The average luminance calculation unit 195 stores the calculated average in the storage unit 145. The average luminance calculation unit 195 instructs the luminance determination unit 200 to perform processing.

When the instruction to perform the processing is given from the average luminance calculation unit 195, the luminance determination unit 200 refers to, through the storage unit 145, the average calculated by the average luminance calculation unit 195. The luminance determination unit 200 determines whether or not the average of the luminance of all the pixels, which is calculated by the average luminance calculation unit 195, is equal to or more than the third threshold (step S190). In a case where the average of the luminance of all the pixels is equal to or more than the third threshold, the luminance determination unit 200 instructs the correction unit 135 to perform processing of step S195. In a case where the average of the luminance of all the pixels is less than the third threshold, the luminance determination unit 200 instructs the correction unit 135 to perform processing of step S200.

The correction unit 135 is instructed by the luminance determination unit 200 to perform the processing of step S195. The correction unit 135 refers to the accumulated deterioration amount which is accumulated by the deterioration amount accumulation unit 125 and stored in the storage unit 145 and a relationship between the accumulated deterioration amount and luminance, which is stored in advance in the aged deterioration characteristic storage unit 155. The correction unit 135 corrects luminance of a pixel other than a pixel whose accumulated deterioration amount is largest, in accordance with luminance of the pixel whose accumulated deterioration amount is largest (step S195). Processing of the correction unit 135 here is as described above.

Further, the correction unit 135 is instructed by the luminance determination unit 200 to perform the processing of step S200. In accordance with luminance of a pixel corresponding to a pixel circuit Aij whose organic light-emitting element is not deteriorated, the correction unit 135 corrects luminance based on the accumulated deterioration amount of the organic light-emitting element of each of pixel circuits Aij whose organic light-emitting element is deteriorated (step S200). Processing of the correction unit 135 here is as described above. The correction unit 135 stores the corrected image data in the output data storage unit 150 and instructs the display control unit 105 to perform processing. Processing of step S140 is similar to that of the display device 1.

Thus, in the display device 4, in the case where the average calculated by the average luminance calculation unit 195 is equal to or more than the third threshold, in accordance with the luminance of the pixel whose deterioration amount accumulated by the deterioration amount accumulation unit 125 is largest, luminance of a pixel other than the pixel whose deterioration amount accumulated by the deterioration amount accumulation unit 125 is largest is corrected. As a result, in the case where the average calculated by the average luminance calculation unit 195 is equal to or more than the third threshold, for example, even when a range of correction that allows an increase in luminance is small, a difference of luminance is able to be reduced as a whole in accordance with the luminance of the pixel whose deterioration amount is largest.

Moreover, in the case where the average calculated by the average luminance calculation unit 195 is less than the third threshold, in accordance with the luminance of the pixel whose organic light-emitting element is not deteriorated, the luminance of the pixel whose organic light-emitting element is deteriorated is corrected. As a result, a difference of luminance is able to be reduced as a whole in accordance with the luminance of the pixel whose organic light-emitting element is not deteriorated.

Example of Realization by Software

A control block (particularly, the image data acquisition unit 115, the deterioration amount increment calculation unit 120, the deterioration amount accumulation unit 125, the threshold determination unit 130, the correction unit 135, the region division unit 160, the total deterioration amount calculation unit 165, the average deterioration amount calculation unit 170, the average deterioration amount accumulation unit 175, or the deterioration amount determination unit 180) of the image data correction circuit 110, 111, or 112 may be realized by a logic circuit (hardware) formed in an integrated circuit (IC chip) or the like or may be realized by software with use of a CPU (Central Processing Unit).

In the latter case, the image data correction circuit 110, 111, or 112 includes a CPU that executes a command of a program that is software enabling each of functions, a ROM (Read Only Memory) or a storage device (each referred to as a "recording medium") in which the program and various kinds of data are recorded so as to be readable by a computer (or a CPU), a RAM (Random Access Memory) that develops the program, and the like. An object of the invention is achieved by a computer (or a CPU) reading and executing the program from the recording medium. As the recording medium, for example, a "non-transitory tangible medium" such as a tape, a disk, a card, a semiconductor memory, or a programmable logic circuit is able to be used. The program may be supplied to the computer via any transmission medium (such as a communication network or a broadcast wave) which allows the program to be transmitted. Note that, an aspect of the invention can also be achieved in a form of a data signal in which the program is embodied through electronic transmission and which is embedded in a carrier wave.

CONCLUSION

A display device 1, 3 according to an aspect 1 of the invention is a display device 1 including a display unit 20 in which a plurality of pixels each including an organic light-emitting element are provided, and includes: a calculation unit (deterioration amount increment calculation unit 120) that calculates an increment of a deterioration amount of the organic light-emitting element included in each of the pixels, based on gradation data included in image data displayed in the display unit; an accumulation unit (deterioration amount accumulation unit 125) that accumulates, every fixed time, the increment of the deterioration amount calculated by the calculation unit; and a correction unit 135 that corrects luminance of the pixel based on a total amount of increments of the deterioration amount accumulated by the accumulation unit.

According to the aforementioned configuration, the accumulation unit accumulates the increment of the deterioration amount every fixed time. Therefore, for example, when considering that information about the deterioration amount is stored in the storage unit, the information about the deterioration amount to be stored in the storage unit is able to be reduced. Accordingly, even in a case where the information about the deterioration amount increases when the number of pixels is large, the information about the deterioration amount is able to be continuously stored in the storage unit for a long time period. As a result, the display device is able to correct image data for a long time period even when the number of pixels is large.

In the display device 1, 3 according to an aspect 2 of the invention, after correcting the luminance of the pixel, in a case where a maximum value of the luminance of the pixel is equal to or less than an upper limit value that allows display of the display unit 20, the correction unit 135 may correct luminance of a pixel whose organic light-emitting element is deteriorated, in accordance with luminance of a pixel whose organic light-emitting element is not deteriorated, and after correcting the luminance of the pixel, in a case where the maximum value of the luminance of the pixel exceeds the upper limit value, the correction unit 135 may correct luminance of a pixel other than a pixel whose total amount of the increments of the deterioration amount accumulated by the accumulation unit (deterioration amount accumulation unit 125) is largest, in accordance with luminance of the pixel whose total amount of the increments of the deterioration amount accumulated by the accumulation unit is largest, in the aspect 1.

According to the aforementioned configuration, after correcting the luminance of the pixel, in the case where the maximum value of the luminance of the pixel is equal to or less than the upper limit value that allows display, the correction unit corrects the luminance of the pixel whose organic light-emitting element is deteriorated in accordance with the luminance of the pixel whose organic light-emitting element is not deteriorated. As a result, it is possible to reduce a difference of the luminance as a whole in accordance with the luminance of the pixel whose organic light-emitting element is not deteriorated.

Moreover, after correcting the luminance of the pixel, in the case where the maximum value of the luminance of the pixel exceeds the upper limit value, the correction unit corrects the luminance of the pixel other than the pixel whose total amount of the increments of the deterioration amount accumulated by the accumulation unit is largest, in accordance with the luminance of the pixel whose total amount of the increments of the deterioration amount accumulated by the accumulation unit is largest. As a result, it is possible to reduce a difference of the luminance as a whole in accordance with the luminance of the pixel whose total amount of the increments of the deterioration amount is largest even when the maximum value of the corrected luminance exceeds the upper limit value that allows display of the display unit.

The display device 4 according to an aspect 3 of the invention may further include: an adjustment unit (image data adjustment unit 185) that adjusts luminance of a pixel in accordance with a peripheral brightness; and an average calculation unit (average luminance calculation unit 195) that calculates an average of luminance of all the pixels on a basis of the image data, in which in a case where the average calculated by the average calculation unit is equal to or more than a predetermined threshold (third threshold), the correction unit 135 may correct luminance of a pixel other than a pixel whose total amount of the increments of the deterioration amount accumulated by the accumulation unit (deterioration amount accumulation unit 125) is largest, in accordance with luminance of the pixel whose total amount of the increments of the deterioration amount accumulated by the accumulation unit is largest, and in a case where the average calculated by the average calculation unit is less than the predetermined threshold (third threshold), the correction unit 135 may correct luminance of a pixel whose organic light-emitting element is deteriorated, in accordance with luminance of a pixel whose organic light-emitting element is not deteriorated, in the aspect 1.

According to the aforementioned configuration, in the case where the average calculated by the average calculation unit is equal to or more than the predetermined value, in accordance with the luminance of the pixel whose total amount of the increments of the deterioration amount accumulated by the accumulation unit is largest, the luminance of the pixel other than the pixel whose total amount of the increments of the deterioration amount accumulated by the accumulation unit is largest is corrected. As a result, in the case where the average calculated by the average calculation unit is equal to or more than the predetermined threshold, for example, even when a range of correction that allows an increase in luminance is small, a difference of luminance is able to be reduced as a whole in accordance with the luminance of the pixel whose total amount of the increments of the deterioration amount is largest.

Moreover, in the case where the average calculated by the average calculation unit is less than the predetermined threshold, in accordance with the luminance of the pixel whose organic light-emitting element is not deteriorated, the luminance of the pixel whose organic light-emitting element is deteriorated is corrected. As a result, a difference of luminance is able to be reduced as a whole in accordance with the luminance of the pixel whose organic light-emitting element is not deteriorated.

An image data correction method according to an aspect 4 of the invention is an image data correction method in a display device including a display unit in which a plurality of pixels each including an organic light-emitting element are provided, and includes: a calculation step of calculating an increment of a deterioration amount of the organic light-emitting element included in each of the pixels, based on gradation data included in image data displayed in the display unit; an accumulation step of accumulating, every fixed time, the increment of the deterioration amount calculated at the calculation step; and a correction step of correcting luminance of the pixel based on the deterioration amount accumulated at the accumulation step.

According to the aforementioned configuration, at the accumulation step, the increment of the deterioration amount is accumulated every fixed time. Therefore, for example, when considering that information about the deterioration amount is stored in the storage unit, the information about the deterioration amount to be stored in the storage unit is able to be reduced. Accordingly, even in a case where the information about the deterioration amount increases when the number of pixels is large, the information about the deterioration amount is able to be continuously stored in the storage unit for a long time period. As a result, the image data correction method enables to correct image data for a long time period even when the number of pixels is large.

In the image data correction method according to an aspect 5 of the invention, at the correction step, after correcting the luminance of the pixel, in a case where a maximum value of the luminance of the pixel is equal to or less than an upper limit value that allows display of the display unit, luminance of a pixel whose organic light-emitting element is deteriorated may be corrected in accordance with luminance of a pixel whose organic light-emitting element is not deteriorated, and after correcting the luminance of the pixel, in a case where the maximum value of the luminance of the pixel exceeds the upper limit value, luminance of a pixel other than a pixel whose total amount of increments of the deterioration amount accumulated at the accumulation step is largest may be corrected in accordance with luminance of the pixel whose total amount of the increments of the deterioration amount accumulated at the accumulation step is largest, in the aspect 4.

According to the aforementioned configuration, at the correction step, after correcting the luminance of the pixel, in the case where the maximum value of the luminance of the pixel is equal to or less than the upper limit value that allows display, the luminance of the pixel whose organic light-emitting element is deteriorated is corrected in accordance with the luminance of the pixel whose organic light-emitting element is not deteriorated. As a result, it is possible to reduce a difference of the luminance as a whole in accordance with the luminance of the pixel whose organic light-emitting element is not deteriorated.

Moreover, at the correction step, after correcting the luminance of the pixel, in the case where the maximum value of the luminance of the pixel exceeds the upper limit value, the luminance of the pixel other than the pixel whose deterioration amount accumulated at the accumulation step is largest is corrected in accordance with the luminance of the pixel whose deterioration amount accumulated at the accumulation step is largest. As a result, it is possible to reduce a difference of the luminance as a whole in accordance with the luminance of the pixel whose deterioration amount is largest even when the maximum value of the corrected luminance exceeds the upper limit value that allows display.

A display device 2 according to an aspect 6 of the invention is a display device 1 including a display unit 20 in which a plurality of pixels each including an organic light-emitting element are provided, and includes: a region division unit 160 that divides a display surface of the display unit into a plurality of regions; a total deterioration amount calculation unit 165 that calculates, for each of the regions, a total of increments of deterioration amounts of organic light-emitting elements included in respective pixels in the region, based on gradation data included in image data displayed in the display unit 20; an average deterioration amount calculation unit 170 that calculates an average of the increments of the deterioration amounts of the organic light-emitting elements based on the total; an average accumulation unit (average deterioration amount accumulation unit 175) that accumulates the average; and a correction unit 135 that corrects luminance of the pixels based on the average accumulated by the average accumulation unit.

According to the aforementioned configuration, the average accumulation unit accumulates the average of the increments of the deterioration amounts of the organic light-emitting elements for each of the regions. Therefore, an accumulation amount of the deterioration amount is smaller than that in a case where the increment of the deterioration amount is accumulated for each of pixels. For example, when considering that information about the deterioration amount is stored in the storage unit, the information about the deterioration amount to be stored in the storage unit is able to be reduced. Accordingly, even in a case where the information about the deterioration amount increases when the number of pixels is large, the information about the deterioration amount is able to be continuously stored in the storage unit for a long time period. As a result, the display device is able to correct image data for a long time period even when the number of pixels is large.

An image data correction method according to an aspect 7 of the invention is an image data correction method in a display device including a display unit in which a plurality of pixels each including an organic light-emitting element are provided, and includes: a region division step of dividing a display surface of the display unit into a plurality of regions; a total deterioration amount calculation step of calculating, for each of the regions, a total of increments of deterioration amounts of organic light-emitting elements included in respective pixels in the region, based on gradation data included in image data displayed in the display unit; an average deterioration amount calculation step of calculating an average of the increments of the deterioration amounts of the organic light-emitting elements based on the total; an average accumulation step of accumulating the average; and a correction step of correcting luminance of the pixels based on the average accumulated at the average accumulation step.

According to the aforementioned configuration, at the average accumulation step, the average of the increments of the deterioration amounts of the organic light-emitting element is accumulated for each of the regions. Therefore, an accumulation amount of the deterioration amount is smaller than that in a case where the increment of the deterioration amount is accumulated for each of pixels. For example, when considering that information about the deterioration amount is stored in the storage unit, the information about the deterioration amount to be stored in the storage unit is able to be reduced. Accordingly, even in a case where the information about the deterioration amount increases when the number of pixels is large, the information about the deterioration amount is able to be continuously stored in the storage unit for a long time period. As a result, the display device is able to correct image data for a long time period even when the number of pixels is large.

The invention is not limited to each of the embodiments described above, and may be modified in various manners within the scope indicated in the claims and an embodiment achieved by appropriately combining technical means disclosed in different embodiments is also encompassed in the technical scope of the invention. Further, by combining the technical means disclosed in each of the embodiments, a new technical feature may be formed.

REFERENCE SIGNS LIST

1, 2, 3, 4 display device
10, 11, 12, 13 display control circuit
20 display unit
30 source driver circuit
40 gate driver circuit
105 display control nit
110, 111, 112, 113 image data correction circuit
115 image data acquisition unit
120 deterioration amount increment calculation unit (calculation unit)
125 deterioration amount accumulation unit (accumulation unit)
130 threshold determination unit
135 correction unit
145 storage unit
150 output data storage unit
155 aged deterioration characteristic storage unit
160 region division unit
165 total deterioration amount calculation unit
170 average deterioration amount calculation unit
175 average deterioration amount accumulation unit (average accumulation unit)
180 deterioration amount determination unit
185 image data adjustment unit
190 total luminance calculation unit (average calculation unit)
195 average luminance calculation unit (average calculation unit)
200 luminance determination unit
205 region
305 shift register
310 register
315 latch circuit
Aij pixel circuit
Gi scanning line
Sj data line

The invention claimed is:

1. A display device including a display unit in which a plurality of pixels each including an organic light-emitting element are provided, the display device comprising:

a calculation unit that calculates an increment of a deterioration amount of the organic light-emitting element included in each of the pixels, based on gradation data included in image data displayed in the display unit;

an accumulation unit that accumulates, every fixed time, the increment of the deterioration amount calculated by the calculation unit; and a correction unit that corrects luminance of the pixel based on a total amount of increments of the deterioration amount accumulated by the accumulation unit, wherein after correcting the luminance of the pixel, in a case where a maximum value of the luminance of the pixel is equal to or less than an upper limit value that allows display of the display unit, the correction unit corrects luminance of a pixel whose organic light-emitting element is deteriorated, in accordance with luminance of a pixel whose organic light-emitting element is not deteriorated, and after correcting the luminance of the pixel, in a case where the maximum value of the luminance of the pixel exceeds the upper limit value, the correction unit corrects luminance of a pixel other than a pixel whose total amount of the increments of the deterioration amount accumulated by the accumulation unit is largest, in accordance with luminance of the pixel whose total amount of the increments of the deterioration amount accumulated by the accumulation unit is largest.

2. A display device including a display unit in which a plurality of pixels each including an organic light-emitting element are provided, the display device comprising:

a calculation unit that calculates an increment of a deterioration amount of the organic light-emitting element included in each of the pixels, based on gradation data included in image data displayed in the display unit;

an accumulation unit, that accumulates, every fixed time, the increment of the deterioration amount calculated by the calculation unit;

a correction unit that corrects luminance of the pixel based on a total amount of increments of the deterioration amount accumulated by the accumulation unit;

an adjustment unit that adjusts luminance of a pixel in accordance with a peripheral brightness; and an average calculation unit that calculates an average of luminance of all the pixels based on the image data, wherein in a case where the average calculated by the average calculation unit is equal to or more than a predetermined threshold, the correction unit corrects luminance of a pixel other than a pixel whose total amount of the increments of the deterioration amount accumulated by the accumulation unit is largest, in accordance with luminance of the pixel whose total amount of the increments of the deterioration amount accumulated by the accumulation unit is largest, and in a case where the average calculated by the average calculation unit is less than the predetermined threshold, the correction unit corrects luminance of a pixel whose organic light-emitting element is deteriorated, in accordance with luminance of a pixel whose organic light-emitting element is not deteriorated.

3. An image data correction method in a display device including a display unit in which a plurality of pixels each including an organic light-emitting element are provided, the method comprising:

a calculation step of calculating an increment of a deterioration amount of the organic light-emitting element included in each of the pixels, based on gradation data included in image data displayed in the display unit;

an accumulation step of accumulating, every fixed time, the increment of the deterioration amount calculated at the calculation step; and a correction step of correcting luminance of the pixel based on the deterioration amount accumulated at the accumulation step, wherein at the correction step, after correcting the luminance of the pixel, in a case where a maximum value of the luminance of the pixel is equal to or less than an upper limit value that allows display of the display unit, luminance of a pixel whose organic light-emitting element is deteriorated is corrected in accordance with luminance of a pixel whose organic light-emitting element is not deteriorated, and after correcting the luminance of the pixel, in a case where the maximum value of the luminance of the pixel exceeds the upper limit value, luminance of a pixel other than a pixel whose total amount of increments of the deterioration amount accumulated at the accumulation step is largest is corrected in accordance with luminance of the pixel whose total amount of the increments of the deterioration amount accumulated at the accumulation step is largest.

* * * * *